US009920454B2

(12) United States Patent
Sutti et al.

(10) Patent No.: US 9,920,454 B2
(45) Date of Patent: Mar. 20, 2018

(54) FIBRE-FORMING PROCESS AND FIBRES PRODUCED BY THE PROCESS

(71) Applicant: HEIQ PTY LTD, Victoria (AU)

(72) Inventors: Alessandra Sutti, Torquay (AU); Tong Lin, Grovedale (AU); Mark Alexander Kirkland, Batesford (AU)

(73) Assignee: Heiq Pty Ltd, Victoria (AU)

( * ) Notice: Subject to any disclaimer, the term of this patent is extended or adjusted under 35 U.S.C. 154(b) by 219 days.

(21) Appl. No.: 14/352,209

(22) PCT Filed: Oct. 18, 2012

(86) PCT No.: PCT/AU2012/001273

§ 371 (c)(1),
(2) Date: Apr. 16, 2014

(87) PCT Pub. No.: WO2013/056312

PCT Pub. Date: Apr. 25, 2013

(65) Prior Publication Data

US 2014/0264985 A1 Sep. 18, 2014

(30) Foreign Application Priority Data

Oct. 18, 2011 (AU) ..... 2011904299

(51) Int. Cl.

| | |
|---|---|
| ***D01D 5/40*** | (2006.01) |
| ***D01D 5/06*** | (2006.01) |
| ***D01D 5/26*** | (2006.01) |
| ***D01F 1/10*** | (2006.01) |
| ***D01F 4/02*** | (2006.01) |
| ***D01F 6/16*** | (2006.01) |
| ***D01F 6/22*** | (2006.01) |
| ***D01F 6/30*** | (2006.01) |
| ***D01F 6/36*** | (2006.01) |
| ***D01F 6/62*** | (2006.01) |
| ***D01F 9/00*** | (2006.01) |
| ***D04H 1/4326*** | (2012.01) |
| *D01F 6/00* | (2006.01) |

(52) U.S. Cl.

CPC ..... *D01D 5/40* (2013.01); *D01D 5/06* (2013.01); *D01D 5/26* (2013.01); *D01F 1/10* (2013.01); *D01F 4/02* (2013.01); *D01F 6/16* (2013.01); *D01F 6/22* (2013.01); *D01F 6/30* (2013.01);

(Continued)

(58) Field of Classification Search

CPC ..... D01D 5/40; D01D 5/06; D01D 5/26

See application file for complete search history.

(56) References Cited

U.S. PATENT DOCUMENTS

| | | | |
|---|---|---|---|
| 4,219,512 | A | 8/1980 | Sinn et al. |
| 4,511,623 | A | 4/1985 | Yoon et al. |

(Continued)

FOREIGN PATENT DOCUMENTS

| | | | |
|---|---|---|---|
| CN | 1418991 | A | 5/2003 |
| EP | 0303247 | B1 | 3/1994 |

(Continued)

OTHER PUBLICATIONS

Sutti, Alessandra et al., "Shear-Enhanced Solution Precipitation: A Simple Process to Produce Short Polymeric Nanofibers" Journal of Nanoscience and Nanotechnology (2011), vol. 11(10), pp. 8947-8952.

(Continued)

*Primary Examiner* — William P Bell

(74) *Attorney, Agent, or Firm* — McDonnell Boehnen Hulbert & Berghoff LLP

(57) ABSTRACT

The present invention relates to a process for the preparation of fibers and fibers prepared by the process. The process can provide discontinuous colloidal polymer fibers in a process that employs a low viscosity dispersion medium.

19 Claims, 10 Drawing Sheets

(52) U.S. Cl.
CPC ..... *D01F 6/36* (2013.01); *D01F 6/625* (2013.01); *D01F 9/00* (2013.01); *D04H 1/4326* (2013.01)

(56) References Cited

U.S. PATENT DOCUMENTS

| | | | | |
|---|---|---|---|---|
| 4,836,507 | A * | 6/1989 | Yang | D01D 5/26 264/143 |
| 5,863,652 | A * | 1/1999 | Matsumura | A24D 3/10 264/187 |
| 7,323,540 | B2 | 1/2008 | Velev et al. | |
| 2010/0247908 | A1 | 9/2010 | Velev et al. | |

FOREIGN PATENT DOCUMENTS

| | | | | |
|---|---|---|---|---|
| EP | 0711512 | A2 | 5/1996 | |
| GB | 2258251 | A * | 2/1993 | C08B 30/12 |
| JP | 53-052726 | A | 5/1978 | |
| JP | 64-068513 | A | 3/1989 | |
| WO | WO 9523250 | A1 * | 8/1995 | A61L 15/62 |

OTHER PUBLICATIONS

Supplementary European Search Report for EP12842044, dated Mar. 27, 2015.

* cited by examiner

FIBRE-FORMING PROCESS AND FIBRES PRODUCED BY THE PROCESS

This application is a U.S. national phase of International Application No. PCT/AU2012/001273, filed Oct. 18, 2012, which claims priority to AU Applicant Serial No. 2011904299, the disclosures of which are hereby incorporated by reference in their entirety.

FIELD OF THE INVENTION

The present invention generally relates to a process for the preparation of fibres. The present invention also relates to fibres prepared by the process. The fibres produced by the process can be discontinuous, colloidal polymer fibres.

BACKGROUND

Polymer fibres can be prepared using a number of different techniques. One technique that may be used is electrospinning, which can produce continuous polymer fibres with controllable fibre diameter, composition and fibre orientation. However, while this technique is relatively simple and has wide applicability, it is generally not suitable for the production of discontinuous polymer fibres.

The production of discontinuous polymer fibres can instead be achieved using template techniques such as template replication and microfluidics. Although such techniques ensure high morphological and dimensional control, the post-treatment needed to recover the polymer fibres is often difficult and leads to very low production rates.

Dispersion of a polymer solution in a non-solvent is a conventional process widely used for the purification of polymers and for the production of nano- and micro-sized powders in industry. A process for fabricating polymer rods based on the solution dispersion concept has been described in U.S. Pat. No. 7,323,540. This process involves the formation of droplets of polymer solution in a viscous non-solvent, followed by deformation and elongation of the droplets under shear to produce insoluble polymer rods. However, this process employs polymer solutions in organic solvents and high viscosity dispersants to form the polymer rods. The use of viscous dispersants and organic solvents may make it difficult to purify and isolate the resulting polymer fibres.

It would be desirable to provide a process for the preparation of fibres that address one or more of the above disadvantages.

The discussion of the background to the invention is intended to facilitate an understanding of the invention. However, it should be appreciated that the discussion is not an acknowledgement or admission that any of the material referred to was published, known or part of the common general knowledge as at the priority date of the application.

SUMMARY

In one aspect, the present invention provides a process for the preparation of fibres including the steps of:

(a) introducing a stream of fibre-forming liquid into a dispersion medium having a viscosity in the range of from about 1 to 100 centiPoise (cP);
(b) forming a filament from the stream of fibre-forming liquid in the dispersion medium; and
(c) shearing the filament under conditions allowing fragmentation of the filament and the formation of fibres.

In embodiments of the process, the dispersion medium has a viscosity in the range of from about 1 to 50 centiPoise (cP). In some embodiments, the dispersion medium has a viscosity in the range of from about 1 to 30 centiPoise (cP), or from about 1 to 15 centiPoise (cP).

In some embodiments, the fibre-forming liquid has a viscosity in the range of from about 3 to 100 centiPoise (cP). In some embodiments, the fibre-forming liquid has a viscosity in the range of from about 3 to 60 centiPoise (cP).

The relationship between the viscosity of the fibre-forming liquid ($\mu 1$) to the viscosity of the dispersion medium ($\mu 2$) may be expressed as a viscosity ratio (p), where $p=\mu 1/\mu 2$. In one form of the invention, the viscosity ratio is in the range of from about 2 to 100. In some embodiments, the viscosity ratio is in the range of from about 2 to 50.

In some embodiments, the filament may be a gelled filament. In forming the gelled filament the fibre-forming liquid may exhibit a gelation rate in the range of from about $1\times10^{-6}$ m/sec$^{1/2}$ to $1\times10^{-2}$ m/sec$^{1/2}$ in the dispersion medium.

The shearing of the filament to provide the fibres may be carried out at a suitable shear stress. In some embodiments, the shearing of the gelled filament includes applying a shear stress in the range of from about 100 to about 190,000 cP/sec.

In some embodiments, it may be advantageous to carry out the process at a controlled temperature. In some embodiments, the process may be carried out a temperature not exceeding 50° C. For example, in some embodiments steps (a), (b) and (c) are carried out at a temperature not exceeding 50° C. In some embodiments, steps (a), (b) and (c) are carried out at a temperature not exceeding 30° C. In some embodiments, steps (a), (b) and (c) are carried out at a temperature in the range of from about −200° C. to about 10° C. In embodiments of the invention low temperature may be useful to prepare fibres of controlled dimensions.

In one set of embodiments the fibre-forming liquid is in the form of a fibre-forming solution including at least one fibre-forming substance in a suitable solvent. The fibre-forming substance may be a polymer or a polymer precursor, which may be dissolved in the solvent. In some embodiments the fibre-forming solution includes at least one polymer.

One aspect of the present invention provides a process for the preparation of fibres including the steps of:

(a) introducing a stream of fibre-forming solution into a dispersion medium having a viscosity in the range of from about 1 to 100 centiPoise (cP);
(b) forming a filament from the stream of fibre-forming solution in the dispersion medium; and
(c) shearing the filament under conditions allowing fragmentation of the filament and formation of fibres.

In one set of embodiments that fibre-forming solution may be a polymer solution including at least one polymer dissolved or dispersed in a solvent. The polymer solution can be used to form polymer fibres.

One aspect of the present invention provides a process for the preparation of polymer fibres including the steps of:

(a) introducing a stream of polymer solution into a dispersion medium having a viscosity in the range of from about 1 to 100 centiPoise (cP);
(b) forming a filament from the stream of polymer solution in the dispersion medium; and
(c) shearing the filament under conditions allowing fragmentation of the filament and formation of polymer fibres.

The process of the invention may be used to prepare polymer fibres from a range of polymer materials. Suitable polymer materials include natural polymers or derivatives thereof, such as polypeptides, polysaccharides, glycoproteins and combinations thereof, or synthetic polymers, and co-polymers of synthetic and natural polymers.

In some embodiments, the process of the invention is used to prepare fibres from water-soluble or water-dispersible polymers. In such embodiments, the fibre-forming liquid may include a water-soluble or water-dispersible polymer. The fibre-forming liquid may be a polymer solution including a water-soluble or water-dispersible polymer may be dissolved in an aqueous solvent. In some embodiments, the water-soluble or water-dispersible polymer may be a natural polymer, or a derivative thereof.

In some embodiments the process of the invention is used to prepare fibres from organic solvent soluble polymers. In such embodiments, the fibre-forming liquid may include an organic solvent soluble polymer. The fibre-forming liquid may be a polymer solution including an organic solvent soluble polymer dissolved in an organic solvent.

In exemplary embodiments of the process of the invention, the fibre-forming liquid may include at least one polymer selected from the group consisting of polypeptides, alginates, chitosan, starch, collagen, silk fibroin, polyurethanes, polyacrylic acid, polyacrylates, polyacrylamides, polyesters, polyolefins, boronic acid functionalised polymers, polyvinylalcohol, polyallylamine, polyethyleneimine, poly(vinyl pyrrolidone), poly(lactic acid), polyether sulfone and inorganic polymers.

In some embodiments, the fibre-forming substance may be a polymer precursor. In such embodiments the fibre-forming liquid may include at least polymer precursor selected from the group consisting of polyurethane prepolymers, and organic/inorganic sol-gel precursors.

The dispersion medium used in the process of the invention includes at least one suitable solvent. In some embodiments, the dispersion medium includes at least one solvent selected from the group consisting of an alcohol, an ionic liquid, a ketone solvent, water, a cryogenic liquid, and dimethyl sulfoxide. In exemplary embodiments, the dispersion medium includes a solvent selected from the group consisting of $C_2$ to $C_4$ alcohols. The dispersion medium may include a non-solvent for the fibre-forming substance present in the fibre-forming liquid.

The dispersion medium may include a mixture of two or more solvents, such as a mixture of water and an aqueous soluble solvent, a mixture of two or more organic solvents, or a mixture of an organic and an aqueous soluble solvent.

The fibre-forming liquid may be introduced to the dispersion medium using a suitable technique. In some embodiments, the fibre-forming liquid is injected into the dispersion medium. The fibre-forming liquid may be injected into the dispersion medium at a rate in a range selected from about 0.0001 L/hr to about 10 L/hr, or from about 0.1 L/hr to 10 L/hr.

The fibre-forming liquid employed in the process of the invention may include an amount of fibre-forming substance in the range of from about 0.1 to 50% (w/v). In one set of embodiments the fibre-forming liquid is a polymer solution including an amount of polymer in the range of from about 0.1 to 50% (w/v). In embodiments where the fibre-forming liquid includes a polymer (such as in a polymer solution), the polymer may have a molecular weight in the range of from about $1\times10^4$ to $1\times10^7$. Polymer concentration and molecular weight may be adjusted to provide a fibre-forming liquid of the desired viscosity.

In some embodiments, the fibre-forming liquid and/or the dispersion medium may further include at least one additive. The additive may be at least one selected from the group consisting of particles, crosslinking agents, plasticisers, multifunctional linkers and coagulating agents.

The present invention further provides fibres prepared by the process of any one of the embodiments described herein. In one set of embodiments the fibres are polymer fibres. The fibres may have controlled dimensional characteristics.

In some embodiments fibres prepared by the process have a diameter in the range of from about 15 nm to about 5 μm. In one set of embodiments that fibres may have a diameter in the range of from about 40 nm to about 5 μm.

In some embodiments, fibres prepared by the process have a length of at least about 1 μm. For example, the fibres prepared by the process may have a length of at least about 100 μm, or a length of at least 3 mm. In one set of embodiments, the fibres have a length in the range of from about 1 μm to about 3 mm.

The present invention further provides an article including fibres prepared by the process of any one of the embodiments described herein. The fibres may be included on a surface of the article. The article may be medical device or a biomaterial, or an article for filtration or printing applications.

BRIEF DESCRIPTION OF THE DRAWINGS

The present invention will now be described with reference to the figures of the accompanying drawings, wherein.

DETAILED DESCRIPTION

Figure 1:
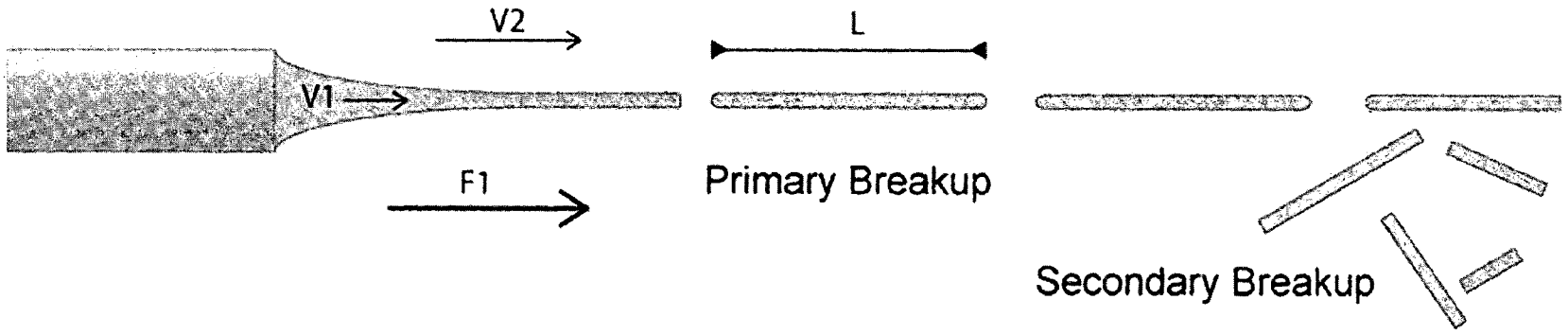
FIG. 1 is an illustration showing the mechanism of fibre formation in accordance with embodiments of the present invention.

The present invention relates a process for preparing fibres. The process of the invention provides discontinuous fibres, rather than continuous fibres. Further, the fibres prepared by the process of the invention are colloidal (short) fibres.

In a first aspect, the present invention provides a process for the preparation of fibres including the steps of:

(a) introducing a stream of fibre-forming liquid into a dispersion medium having a viscosity in the range of from about 1 to 100 centiPoise (cP);

(b) forming a filament from the stream of fibre-forming liquid in the dispersion medium; and (c) shearing the filament under conditions allowing fragmentation of the filament and the formation of fibres.

In accordance with the first aspect of the present invention, a fibre-forming liquid is introduced into a dispersion medium. The fibre-forming liquid is generally a flowable viscous liquid and includes at least one fibre-forming substance. The fibre-forming substance may be selected from the group consisting of a polymer, a polymer precursor, and combinations thereof.

The term "polymer" as used herein refers to a naturally occurring or synthetic compound composed of covalently linked monomer units. A polymer will generally contain 10 or more monomer units.

The term "polymer precursor" as used herein refers to a naturally occurring or synthetic compound that is capable of undergoing further reaction to form a polymer. Polymer precursors may include prepolymers, macromonomers and monomers, which can react under selected conditions to form a polymer.

In one set of embodiments the fibre-forming liquid is a molten liquid. The molten liquid includes at least one fibre-forming substance, such as a polymer or polymer precursor, in a molten state. One skilled in the art would understand that a molten liquid may be formed when a fibre-forming substance is heated above its melting temperature. In some embodiments the molten liquid includes at least one polymer in a molten state. In other embodiments the molten liquid includes at least one polymer precursor in a molten state. In some embodiments the molten liquid may include a blend of two or more fibre-forming substances, such as a blend of two or more polymers, a blend of two or more polymer precursors or a blend of a polymer and a polymer precursor, in a molten state.

In one set of embodiments the fibre-forming liquid is a fibre-forming solution. A fibre-forming solution includes at least one fibre-forming substance, such as a polymer or polymer precursor, dissolved or dispersed in a solvent. In some embodiments the fibre-forming solution may include a blend of two or more fibre-forming substances, such as a blend of two or more polymers, a blend of two or more polymer precursors or a blend of a polymer and a polymer precursor, dissolved or dispersed in a solvent.

In some embodiments, the fibre-forming liquid is a fibre-forming solution that includes at least one polymer precursor dissolved or dispersed in a solvent. Such solutions may be referred to herein as a polymer precursor solution.

In some embodiments, the fibre-forming liquid is a fibre-forming solution that includes at least one polymer dissolved or dispersed in a solvent. Such solutions may be referred to herein as a polymer solution. A polymer solution may also include a polymer precursor in addition to the polymer.

As discussed further below, in some embodiments the fibre-forming liquid may optionally include other components, such additives, in addition to the fibre-forming substance.

To carry out the process described herein it is desirable that the viscosity of the fibre-forming liquid be higher than the viscosity of the dispersion medium. In some embodiments, the fibre-forming liquid has a viscosity in the range of from about 3 to 100 centiPoise (cP). In some embodiments, the fibre-forming liquid has a viscosity in the range of from about 3 to 60 centiPoise (cP). When the fibre-forming liquid is a fibre-forming solution, the fibre-forming solution may have a viscosity in the range of from about 3 to 100 centiPoise (cP), or from about 3 to 60 centiPoise (cP). In some embodiments the fibre-forming liquid is a polymer solution. In such embodiments the polymer solution has a viscosity in the range of from about 3 to 100 centiPoise (cP), or from about 3 to 60 centiPoise (cP).

The fibre-forming liquid is introduced as a stream into the dispersion medium. As used herein, the term "stream" indicates that the fibre-forming liquid is introduced as a continuous flow of fluid into the dispersion medium.

The dispersion medium employed in the process of the invention is a liquid that is generally of lower viscosity than the fibre-forming liquid. In accordance with one or more aspects of the invention, the dispersion medium has a viscosity in the range of from about 1 to 100 centiPoise (cP). In some embodiments, the dispersion medium has a viscosity in the range selected from the group consisting of from about 1 to 50 cP, from about 1 to 30 cP, or from about 1 to 15 cP.

The viscosity of the fibre-forming liquid and of the dispersion medium may be determined using conventional techniques. For example, dynamic viscosity measurement may be obtained with a Bohlin Visco or a Brookfield system. The viscosity of the dispersion medium may also be extrapolated from literature data, such as that reported in the CRC Handbook of Chemistry and Physics, 91$^{st}$ edition, 2010-2011, published by CRC Press.

It has been found that the use of a fibre-forming liquid of higher viscosity than the dispersion medium is advantageous as it enables the fibre-forming liquid to exhibit desirable viscous forces and interfacial tension, such that a continuous thread or stream of fluid can be maintained in the presence of the dispersion medium. The provision of a continuous thread or stream of fibre-forming liquid upon exposure to the dispersion medium is in contrast to processes of the prior art, which employ low viscosity polymer solutions that emulsify or break up into discrete droplets when exposed to a dispersant.

The ability to form a continuous stream of fibre-forming liquid in the dispersion medium results from a balance of viscous (dynamic) and surface tension forces between the viscous fibre-forming liquid and the less viscous dispersion medium. One of ordinary skill in the art would appreciate that liquid streams may be subject to capillary instabilities and that the extent and characteristics of such instabilities can influence whether effective formation of a continuous stream can be achieved, or whether local perturbations might be such that the stream is induced to break into droplets. In contrast to the process of the invention, prior art processes that involve the introduction of a polymer solution into a more viscous dispersant results in the generation of discrete droplets of polymer solution in the dispersant due to interfacial tension between the polymer solution and the dispersant promoting droplet formation.

The relationship between the viscosity of the fibre-forming liquid ($\mu_1$) and the viscosity of the dispersion medium ($\mu_2$) may be expressed as a viscosity ratio p, where $p=\mu_1/\mu_2$. In accordance with the process of the invention, it is desirable that the ratio (p) of the viscosity of the fibre-forming liquid to the viscosity of the dispersion medium be greater than 1, reflecting the requirement for a dispersion medium of lower viscosity. A viscosity ratio of greater than 1 provides the necessary conditions for formation of a stable stream of fibre-forming liquid in the presence of the dispersion medium. In some embodiments, the viscosity ratio (p) is in the range of from 2 to 100. In other embodiments, the viscosity ratio (p) is in the range of from 3 to 50. In other embodiments, the viscosity ratio (p) is in the range of from 10 to 50. In other embodiments, the viscosity ratio (p) is in the range of from 20 to 50.

When the fibre-forming liquid is a polymer solution, it is desirable that the ratio (p) of the viscosity of the polymer solution to the viscosity of the dispersion medium be greater than 1. In some embodiments, the viscosity ratio (p) may be in a range selected from the group consisting of from about 2 to 100, from about 3 to 50, from about 10 to 50, and from about 20 to 50.

The stream of fibre-forming liquid may be introduced to the dispersion medium using any suitable technique. In one embodiment, the fibre-forming liquid is injected into the dispersion medium. In one set of embodiments the fibre-forming liquid is injected into the dispersion medium by means of a device having a suitable opening through which the fibre-forming liquid may be ejected. In some embodiments the device may be a nozzle or a needle, for example a syringe needle. In one set of embodiments, the opening of the device may be in contact with the dispersion medium, such that upon ejection of a stream of fibre-forming liquid from the opening, the stream immediately enters the dispersion medium.

The fibre-forming liquid may be injected into the dispersion medium at a suitable rate. For example, the fibre-forming liquid may be injected into the dispersion medium at a rate in a range from about 0.0001 L/hr to 10 L/hr. In some embodiments, the fibre-forming liquid may be injected into the dispersion medium at a rate in a range from about 0.001 L/hr to 10 L/hr. In some embodiments, the fibre-forming liquid may be injected into the dispersion medium at a rate in a range from about 0.1 L/hr to 10 L/hr.

When the fibre-forming liquid is a fibre-forming solution, such as a polymer solution, the fibre-forming solution may be injected into the dispersion medium at a rate in a range selected from the group consisting of from about 0.0001 L/hr to 10 L/hr, from about 0.001 L/hr to 10 L/hr, or from about 0.1 L/hr to 10 L/hr.

One skilled in the relevant art would understand that the rate at which a fibre-forming liquid is introduced to the dispersion medium may be varied according to the scale on which the process of the invention is carried out, the volume of fibre-forming liquid employed, and the desired time for introducing a selected volume of fibre-forming liquid to the dispersion medium. In some embodiments it may be desirable to introduce the fibre-forming liquid into the dispersion medium at a faster rate this may assist in the formation of fibres with smoother surface morphologies. The injection speed may be regulated by means of a pump, such as for example a syringe pump or a peristaltic pump.

In some embodiments, the stream of fibre-forming liquid is introduced to the dispersion medium in the presence of elongational forces. Suitable elongational forces may be gravitational forces or shear forces. In some embodiments, the dispersion medium is sheared during introduction of the fibre-forming liquid into the dispersion medium. In such embodiments, the stream of fibre-forming liquid can be elongated due to the drag force (F) applied to the viscous stream of fibre-forming liquid as it is accelerated from the injection velocity ($V_1$) to the local velocity ($V_2$) of the dispersion medium under shear, which leads to stretching or thinning of the stream of fibre-forming liquid. In some embodiments, introduction of the stream of fibre-forming liquid to the dispersion medium under elongational forces may assist in forming a filament of controllable diameter. This may subsequently enable greater control over the dimensions of the resulting fibres to be achieved, such that fibres having diameters of narrow polydispersity (for example, monodispersity) can be obtained.

Upon introduction of the stream of fibre-forming liquid to the dispersion medium, a filament is formed from the stream of fibre-forming liquid. The filament may be polymer precursor filament when it is formed from a fibre-forming liquid including at least one polymer precursor. The filament may be a polymer filament when it is formed from a fibre-forming liquid including at least one polymer. For example, a polymer filament may be formed upon introduction of a stream of polymer solution to the dispersion medium. The polymer filament may include a mixture of polymer and polymer precursor. Depending on the rate of gelation of the fibre-forming liquid, the filament may be formed immediately upon introduction of the stream of fibre-forming liquid to the dispersion medium, or some time thereafter.

In some embodiments, the introduction of the stream of fibre-forming liquid to the dispersion medium provides a gelled filament. The gelled filament may be a gelled polymer filament when it is formed from a fibre-forming liquid including at least one polymer.

Fibre-forming substances such as polymers or polymer precursors that are present in the stream of fibre-forming liquid can be subject to gelation (precipitation) in the dispersion medium. Gelation induces solidification of the fibre-forming liquid, resulting in a material that is at least semi-solid. Gelation may occur as solvent is removed from the stream of fibre-forming liquid (solvent attrition) or as a coagulant diffuses from the dispersion medium into the fibre-forming liquid. If gelation occurs early as the fibre-forming liquid is being introduced to the dispersion medium, a gelled filament can be formed. The gelled filament may be considered to be a precipitate that is at least semi-solid. Gelation may be controlled by the interfacial tension between the dispersed fibre-forming liquid and the dispersion medium, which governs the mass transfer of solvent from the fibre-forming liquid to the dispersion medium, or the transfer of a coagulant from the dispersion medium into the fibre-forming liquid. The mass transfer of solvent or coagulant can influence the gelation kinetics.

In some embodiments, the fibre-forming liquid exhibits a gelation rate in the range of from about $1\times10^{-6}$ m/sec$^{1/2}$ to $1\times10^{-2}$ m/sec$^{1/2}$ in the dispersion medium. Such gelation rates may favour the formation of elongated fibres of more regular morphology. The gelation rate may be determined by optical or other methods as known in the art and described in articles such as Fang et al. in Journal of Applied Polymer Science 118 (2010), 2553-2561, and Um et al. in International Journal of Biological Macromolecules 34 (2004), 89-105.

A high viscosity fibre-forming liquid can exhibit favourable gelation kinetics, which helps to promote the production of colloidal fibres. In some embodiments, a gelation rate that is fast enough to allow formation a stable gelled filament, yet is slow enough such that the filament is capable of undergoing deformation under shear, can help to promote fibre formation. Other factors influencing gelation rate, including the quantity of fibre-forming substance present in the fibre-forming liquid and temperature, are further discussed below.

Solidification of the stream of fibre-forming liquid by means of gelation and formation of a filament can be important as without solidification, an emulsion may form between the two phases of fibre-forming liquid and dispersion medium in the absence of applied shear.

In one set of embodiments the fibre-forming liquid includes at least one polymer. In such embodiments the polymer in the fibre-forming liquid may solidify in the presence of the dispersion medium to form a filament including the polymer. In some embodiments the filament may be a gelled filament. A filament that includes at least one polymer may also be referred to herein as a polymer filament.

In one other set embodiments the fibre-forming liquid includes at least one polymer precursor. Polymer precursors present in the fibre-forming liquid may solidify in the presence of the dispersion medium to form a filament including the polymer precursor. A filament that includes at least one polymer precursor may also be referred to herein as a polymer precursor filament.

In some embodiments, the polymer precursor may react and form a polymer prior to solidification and filament formation. This may occur if, for example, the polymer precursor reacts as it is introduced to the dispersion medium. In such embodiments, the filament will include a polymer, and may include a mixture of polymer and polymer precursor, where the polymer is formed from the polymer precursor. As such filaments include a polymer, they may be considered to be a polymer filament.

Gelation rates that are too high can give rise to undesirable fibre morphology. For instance, if gelation is too fast (i.e. above $1\times10^{-2}$ m/sec$^{1/2}$), as soon as the fibre-forming liquid contacts the dispersion medium, it will form a hard skin which will prevent the formation of nicely-shaped filament, and therefore short fibres. Instead, precipitates of irregular shape may be obtained.

In some embodiments, the fibre-forming liquid exhibits a low gelation rate. In such circumstances, the fibre-forming liquid should be of sufficient viscosity that it is able to provide a viscous filament upon entering the dispersion medium. The viscous filament is able to break into segments of smaller length, and the segments retain the same shape (elongated) during shearing.

Gelation of the segments during shearing solidifies the segments and results in the formation of fibres. Where the gelation rate is low, shear needs to be applied for a longer length of time in order to obtain fibres. If the shear is removed before gelation is complete, the formed viscous filament segments will instead tend to relax to a non-elongated state (e.g. a spherical shape) upon removal of shear. Accordingly, the gelation rate in such embodiments only determines the duration of the process.

The composition of the fibre-forming liquid may dictate the composition of the filament formed in the processes described herein. For instance, the filament will generally include at least one fibre-forming substance selected from the group consisting of a polymer, a polymer precursor, or a combination thereof. The filament may also include other components in addition to the fibre-forming substance, such as solvents and/or additives, if such components are present in the fibre-forming liquid.

The dispersion medium employed in the process of the invention facilitates solidification of the stream of fibre-forming liquid to allow formation of a filament from the stream of fibre-forming liquid. The dispersion medium generally includes at least one solvent and may include a mixture of two or more solvents.

The dispersion medium may include a coagulant that is capable of inducing gelation or solidification of the fibre-forming liquid and formation of a filament. The coagulant may be capable of interacting with a fibre-forming substance in the fibre-forming liquid.

In one set of embodiments, the dispersion medium includes a non-solvent for a fibre-forming substance present in the fibre-forming liquid. The non-solvent may be considered to be a coagulant. The non-solvent can induce gelation and solidification of a polymer or polymer precursor present in the fibre-forming liquid to allow precipitation of a filament. The non-solvent may diffuse into the stream of fibre-forming liquid to induce filament formation.

In one set of embodiments, the coagulant may be an agent that is capable of non-covalent bonding interactions with a fibre-forming substance, to cause precipitation of the fibre-forming substance when such interactions occur. In some embodiments, the coagulant may be a salt (for example, a metal salt such as sodium salt or calcium salt), a protein, a complexing agent, or a zwitterion. In such embodiments, the solvent present in the dispersion medium may, or may not, be a non-solvent for the fibre-forming substance present in the fibre-forming liquid. For example, the polymer sodium alginate will precipitate when exposed to calcium salts. Accordingly, a viscous aqueous polymer solution containing sodium alginate can be introduced to an aqueous dispersion medium containing a calcium salt. In this case, it is not essential that the aqueous solvent of the dispersion medium be a non-solvent for the polymer, as solidification of the polymer will be possible through its interaction with the calcium salt present in the aqueous dispersion medium.

In one set of embodiments, the coagulant may be an acidic or basic coagulant derived from an organic or inorganic acid, or an organic or inorganic base. The acidic or basic coagulant may be useful in inducing the precipitation of fibre-forming substances that solidify in response to a change in pH.

When a fibre-forming solution is used in the process of the invention, it can be desirable for the solvent of the dispersion medium to be at least partially miscible (e.g. solubility of 1 mL in 100 mL) with the solvent of the fibre-forming solution. In some embodiments, upon introduction of the stream of fibre-forming solution to the dispersion medium, a non-solvent present in the dispersion medium is able to diffuse into the stream of fibre-forming solution. Alternatively, or additionally, the solvent of the fibre-forming solution may diffuse into the dispersion medium. When the dispersion medium includes a non-solvent for a polymer or polymer precursor present in a fibre-forming solution, this can lead to precipitation of the polymer or polymer precursor and formation of a gelled filament in the dispersion medium. In some embodiments, depending on the gelation rate, filament formation may occur in a matter of seconds.

In accordance with the process of the invention, the filament in the dispersion medium is sheared. The shearing of the filament is performed under conditions allowing fragmentation of the filament into shorter lengths. This leads to the formation of fibres in the dispersion medium. When the filament includes at least one polymer, shearing of the filament leads to the formation of polymer fibres.

During shearing of the filament, the movement of solvent and/or coagulant between the dispersion medium and the fibre-forming liquid can continue, resulting in further solidification of the formed fragments and the production of insoluble fibres in the dispersion medium. For example, polymer solvent may continue to diffuse out from the filament fragments and into the dispersion medium. The process of the invention enables rapid formation of a plurality of fibres. For instance, the time period from when the addition of the fibre-forming liquid begins to the dispersion medium to the formation of fibres can be in the order of a few seconds to a few minutes.

In shearing the filament, an appropriate shear stress may be applied to the dispersion medium and to the filament contained in the dispersion medium for a time sufficient to form the fibres. In the case of a gelled filament, it is desirable that the applied shear stress be sufficient to overcome the tensile strength of the filament in order to fragment the filament. The applied shear may vary, depending on the viscosity of the dispersion medium and the amount of polymer material. In some embodiments, the shearing of the filament involves applying a shear stress in the range of from about 100 cP/sec to about 190,000 cP/sec.

Any means or device may be utilized to impart a shearing action to the filament in the dispersion medium in a batch or continuous process. In certain embodiments, one or more surfaces confining the volume of the dispersion medium may be moved (e.g., rotated, translated, twisted, etc.) relative to one or more stationary or other moving surfaces. In some embodiments, the shear can be applied by a mixing vessel equipped with an impeller.

The shear rate (G) applied to the filament may be determined according to Equation 1:

$$G=60(2\pi r\theta/\delta) \quad \text{(Equation 1)}$$

The shear rate is a function of the stirrer, the vessel and the stirring speed.

The shear stress (t) applied to the filament may also be determined according to Equation 2:

$$t=\mu G \quad \text{(Equation 2)}$$

Shear stress may be affected by the viscosity of the dispersant ($\mu$).

In Equation 1, r represents the radius of the propeller blade (meters), $\theta$ represents the speed of rotation (rpm), and $\delta$ represents the gap between the end of the propeller and the edge of the container (meters). In Equation 2, $\mu$ represents the viscosity of the dispersion medium solvent, G represents the shear rate and t represents the shear stress. Thus, Equation 1 and Equation 2 may be used to calculate shear rate and shear stress for different devices operating at different stirring speeds and with different propellers.

In some embodiments, it may be desirable to apply a net high shear stress to the gelled filament. The net shear stress can be varied either changing the stirring speed (e.g. by changing the rpm of the stirring device) or by varying the viscosity of the dispersion medium or fibre-forming liquid. It has been found that shearing the filament at a high shear stress (e.g. by increasing stirring speed) provides fibres with smaller fibre diameters and a narrower distribution of fibre diameters (narrow polydispersity).

In some embodiments, the shear stress may be altered by varying the temperature in which the process of the invention is carried out. In some embodiments, the process of the invention is carried out a temperature not exceeding 50° C. Thus, steps (a), (b) and (c) of the process may be carried out at a temperature of not more than 50° C. In some embodiments, it may be desirable to carry out the process of the invention at a temperature not exceeding 30° C. Thus, steps (a), (b) and (c) of the process may be carried out at a temperature of not more than 30° C. In other embodiments, it may be desirable to carry out the process of the invention at a temperature in the range of from about −200° C. to about 10° C. Thus, steps (a), (b) and (c) of the process may be carried out at a temperature in the range of from about −200° C. to about 10° C. Fibre yield was found to be enhanced at low temperature (e.g. 0° C. and below).

Lower temperatures were found to provide increased fibre yield for a wide range of shear rates. A reduction in operating temperature can increase the viscosity of the fibre-forming liquid and the dispersion medium, inducing an increase in applied shear stress and a reduction in gelation kinetics. An increase in viscosity can inhibit the establishment of capillary instabilities. Interfacial tension may also decrease with temperature. The combination of higher viscosity, lower interfacial tension and lower gelation rates could favour formation of stable filaments and enhanced formation of fibres could result from such concerted action.

Smaller fibre diameters may also be produced by working at lower temperatures. Lowering of the processing temperature can slow the rate of diffusion of solvent or coagulant between the fibre-forming liquid and the dispersion medium. In addition, the mass transfer of solvent or coagulant may also decrease due to increased viscosity of the dispersion media. These effects can lead to slower gelation, which allows the stream of fibre-forming liquid to be further elongated over a period of time before gelation to produce the filament. Consequently, fibres with smaller diameters can be produced.

If desired, the dispersion medium, fibre-forming liquid and/or the apparatus used to form the fibres may be cooled to allow the process to be carried out at a temperature below room temperature. In some embodiments, the process may include the step of cooling the dispersion medium. The dispersion medium may be cooled to a temperature in the range of from about −200° C. to about 10° C. In some embodiments, the process may include the step of cooling the fibre-forming liquid. The fibre-forming liquid may be cooled to a temperature in the range of from about −200° C. to about 10° C.

Upon shearing the filament, the filament fragments and a plurality of fibres is formed in the dispersion medium. The fibres may be suspended in the dispersion medium. The fibres may be separated from the dispersion medium using separation techniques known in the art, such as centrifugation and/or ultrafiltration. The isolated fibres may then be re-suspended or re-dispersed in a further solution or undergo further processing.

In the case of fibres that are produced when a fibre-forming liquid including at least one polymer is used, the resulting polymer fibres may not require further processing, but may be isolated, then used after isolation in a desired application.

In the case of fibres that are produced when a fibre-forming liquid including at least one polymer precursor is used, it may be necessary to treat the fibres under conditions allowing reaction of the polymer precursor and formation of a polymer from the polymer precursor. The conditions for treatment of the polymer precursor fibres will depend on the nature of the polymer precursor and the reaction required to form the polymer. In some embodiments, polymer precursor fibres may be exposed to a suitable initiator, or to heat or radiation (for example UV radiation) to react the polymer precursor contained in the fibres and form a polymer from the polymer precursor.

It is one advantage of the process of the invention that fibres of narrow polydispersity can be formed. In some embodiments, the fibres are monodisperse. Fibres with a monodisperse distribution of fibre diameters may arise when a stable gelled filament subsequently fragments into individual fibres. The resulting fibres therefore maintain a diameter distribution similar to that of the initial filament. This is in contrast with prior art processes that rely on the deformation of spherical droplets to produce fibres.

The fibre-forming liquid employed in the process of the invention includes at least one fibre-forming substance. The fibre-forming substance is selected from the group consisting of a polymer, a polymer precursor, and combinations thereof. In some embodiments, the fibre-forming liquid may include a blend or combination of two or more polymers, two or more polymer precursors, or a polymer and a polymer precursor. The polymer, polymer precursor or mixture of polymers and/or polymer precursors may be dissolved in a solvent.

One advantage of the process of the invention is that it can be applied to the production of fibres from a range of different polymers or polymer precursors. For example, the process of the invention can be used to produce fibres from natural polymers, synthetic polymers, and combinations thereof.

In some embodiments, the stream of fibre-forming liquid may include at least one polymer selected from the group consisting of a natural polymer, a synthetic polymer, and combinations thereof.

In one set of embodiments the fibre-forming liquid may be a molten liquid. The molten liquid includes at least one fibre-forming substance in a molten state.

In one set of embodiments the fibre-forming liquid may be a fibre-forming solution. The fibre-forming solution includes at least one fibre-forming substance dissolved or dispersed in a solvent.

In one aspect, the present invention provides a process for the preparation of polymer fibres including the steps of:

(a) introducing a stream of fibre-forming solution into a dispersion medium having a viscosity in the range of from about 1 to 100 centiPoise (cP);
(b) forming a filament from the stream of fibre-forming solution in the dispersion medium; and
(c) shearing the filament under conditions allowing fragmentation of the filament and the formation of fibres.

In one set of embodiments the fibre-forming solution employed in the process of the invention includes at least one polymer. A fibre-forming solution including at least one polymer may be referred to herein as a polymer solution, and may be used in the process of the invention to form polymer fibres. The polymer solution may include a blend or combination of two or more polymers. The polymer or mixture of polymers may be dissolved in a suitable solvent to form a homogeneous solution. A range of polymers may be used to prepare the fibres, including synthetic or natural polymers.

As used herein, reference to singular forms "a", "an" and "the" is intended to include plural forms, unless the context clearly indicates otherwise.

In one aspect, the present invention provides a process for the preparation of polymer fibres including the steps of:

(a) introducing a stream of polymer solution into a dispersion medium having a viscosity in the range of from about 1 to 100 centiPoise (cP);
(b) forming a filament from the stream of polymer solution in the dispersion medium; and
(c) shearing the filament under conditions allowing fragmentation of the filament and the formation of polymer fibres.

In some embodiments the polymer solution may include at least one polymer selected from the group consisting of a natural polymer, a synthetic polymer, and combinations thereof.

Natural polymers may include polysaccharides, polypeptides, glycoproteins, and derivatives thereof and copolymers thereof. Polysaccharides may include agar, alginates, chitosan, hyaluronan, cellulosic polymers (e.g., cellulose and derivatives thereof as well as cellulose production by-products such as lignin) and starch polymers. Polypeptides may include various proteins, such as silk fibroin, lysozyme, collagen, keratin, casein, gelatin and derivatives thereof. Derivatives of natural polymers, such as polysaccharides and polypeptides, may include various salts, esters, ethers, and graft copolymers. Exemplary salts may be selected from sodium, zinc, iron and calcium salts.

Synthetic polymers may include vinyl polymers such as, but not limited to, polyethylene, polypropylene, poly(vinyl chloride), polystyrene, polytetrafluoroethylene, poly(α-methylstyrene), poly(acrylic acid), poly(methacrylic acid), poly(isobutylene), poly(acrylonitrile), poly(methyl acrylate), poly(methyl methacrylate), poly(acrylamide), poly (methacrylamide), poly(l-pentene), poly(1,3-butadiene), poly(vinyl acetate), poly(2-vinyl pyridine), poly(vinyl alcohol), poly(vinyl pyrrolidone), poly(styrene), poly(styrene sulfonate) poly(vinylidene hexafluoropropylene), 1,4-polyisoprene, and 3,4-polychloroprene. Suitable synthetic polymers may also include non-vinyl polymers such as, but not limited to, poly(ethylene oxide), polyformaldehyde, polyacetaldehyde, poly(3-propionate), poly(10-decanoate), poly (ethylene terephthalate), polycaprolactam, poly(11-undecanoamide), poly(hexamethylene sebacamide), poly(m-phenylene terephthalate), poly(tetramethylene-m-benzenesulfonamide). Copolymers of any one of the aforementioned may also be used.

Synthetic polymers employed in the process of the invention may fall within one of the following polymer classes: polyolefins, polyethers (including all epoxy resins, polyacetals, poly(orthoesters), polyetheretherketones, polyetherimides, poly(alkylene oxides) and poly(arylene oxides)), polyamides (including polyureas), polyamideimides, polyacrylates, polybenzimidazoles, polyesters (e.g. polylactic acid (PLA), polyglycolic acid (PGA), poly(lactic-co-glycolic acid) (PLGA)), polycarbonates, polyurethanes, polyimides, polyamines, polyhydrazides, phenolic resins, polysilanes, polysiloxanes, polycarbodiimides, polyimines (e.g. polyethyleneimine), azo polymers, polysulfides, polysulfones, polyether sulfones. oligomeric silsesquioxane polymers, polydimethylsiloxane polymers and copolymers thereof.

In some embodiments, functionalised synthetic polymers may be used. In such embodiments, the synthetic polymers may be modified with one or more functional groups. Examples of functional groups include boronic acid, alkyne or azido functional groups. Such functional groups will generally be covalently bound to the polymer. The functional groups may allow the polymer to undergo further reaction (for example, to allow fibres formed with the functionalised polymer to be immobilised on a surface), or to impart additional properties to the fibres. For example, boronic acid functionalised fibres may be incorporated in a device for glucose screening.

In some embodiments, the fibre-forming liquid includes a water-soluble or water-dispersible polymer, or a derivative thereof. In some embodiments, the fibre-forming liquid is a polymer solution including a water-soluble or water-dispersible polymer, or a derivative thereof, dissolved in an aqueous solvent. Exemplary water-soluble or water-dispersible polymers that may be present in a fibre-forming liquid such as a polymer solution may be selected from the group consisting of polypeptides, alginates, chitosan, starch, collagen, polyurethanes, polyacrylic acid, polyacrylates, polyacrylamides (including poly(N-alkyl acrylamides) such as poly(N-isopropyl acrylamide), poly(vinyl alcohol), polyallylamine, polyethyleneimine, poly(vinyl pyrrolidone), poly(lactic acid), poly(ethylene-co-acrylic acid), and copolymers thereof and combinations thereof. Derivatives of water-soluble or water-dispersible polymers may include various salts thereof.

In some embodiments, the fibre-forming liquid includes an organic solvent soluble polymer. In some embodiments, the fibre-forming liquid is a polymer solution including an organic solvent soluble polymer dissolved in an organic solvent. Exemplary organic solvent soluble polymers that may be present in a fibre-forming liquid such as a polymer solution include poly(styrene) and polyesters such as poly (lactic acid), poly(glycolic acid), poly(caprolactone) and copolymers thereof, such as poly(lactic-co-glycolic acid).

In some embodiments, the fibre-forming liquid includes hybrid polymer. Hybrid polymers may be inorganic/organic hybrid polymers. Exemplary hybrid polymers include polysiloxanes, such as poly(dimethylsiloxane) (PDMS).

In some embodiments the fibre-forming liquid includes at least one polymer selected from the group consisting of polypeptides, alginates, chitosan, starch, collagen, silk fibroin, polyurethanes, polyacrylic acid, polyacrylates, polyacrylamides, polyesters, polyolefins, boronic acid functionalised polymers, polyvinylalcohol, polyallylamine, polyethyleneimine, poly(vinyl pyrrolidone), poly(lactic acid), polyether sulfone and inorganic polymers.

In some embodiments, fibre-forming liquid may include at least one polymer precursor, such as monomers, macromonomers or prepolymers that undergo further reaction to form a polymer.

In some embodiments, the fibre-forming liquid may include an inorganic polymer precursor. Inorganic polymers may be prepared in situ from suitable precursors. In some embodiments, the fibre-forming liquid may include one or more sol-gel precursors. Examples of sol-gel precursors include tetraethyl orthosilicate (TEOS) and alkoxy silanes. For example, TEOS can undergo hydrolysis in aqueous solutions to form silicon dioxide ($SiO_2$). Other inorganic polymers that may be formed from suitable precursors include $TiO_2$ and $BaTiO_3$. When inorganic polymer precursors are used, the polymer is formed before and/or during gelation of the stream of fibre-forming liquid, and can continue beyond the formation of a gelled filament.

In some embodiments, the fibre-forming liquid may include an organic polymer precursor. Organic polymer precursors may be low molecular weight oligomeric compounds that are capable of undergoing further reaction to form an organic polymer. One example of an organic polymer precursor is an isocyanate terminated oligomer, which is able to react with a diol (chain extension), to form a polymer. Other organic polymer precursors may also be used. Organic polymer precursors that may be used in the process of the invention may be in the form of latex dispersions, such as polyurethane dispersions or nitrile rubber dispersions. Several latex dispersions are commercially available. Commercially available latex dispersions may include organic polymer precursors dispersed in an aqueous solvent. Such commercially available dispersions are capable of being used in the process of the invention as the fibre-forming liquid, and can be used in this manner as supplied.

In some embodiments the fibre-forming liquid may include at least one monomer, and may include a mixture of two or more monomers. Monomers present in the fibre-forming liquid may react under appropriate conditions to form a polymer. Polymer formation may occur before, during or after formation of a filament from the stream of fibre-forming liquid, and may be initiated by appropriate initiator, or by heat or radiation. One skilled in the art will be able to select appropriate monomers that may be used. Non-limiting examples of monomers that may be used include vinyl monomers, epoxy monomers, amino acid monomers, and macromonomers such as oligopeptides. For example, the vinyl monomer 2-cyanoacrylate can rapidly polymerise in the presence of water as polymerisation is initiated by hydroxide ions provided by the water. Accordingly, in introducing a stream of fibre-forming liquid including 2-cyanoacrylate to an aqueous dispersion medium, the 2-cyanoacrylate will rapidly polymerise, resulting in the formation of a filament including cyanoacrylate polymer.

In some embodiments, the fibre-forming liquid includes a mixture of two or more polymers, such as a mixture of a thermoresponsive synthetic polymer (e.g. poly(N-isopropyl acrylamide)) and a natural polymer (e.g. a polypeptide). The use of polymer blends may be advantageous as it provides avenues for fabricating polymer fibres with a range of physical properties (e.g. thermoresponsive and biocompatible or biodegradable properties). The process of the invention can therefore be used to form polymer fibres with tuneable or tailored physical properties by selection of an appropriate blend or mixture of polymers.

Polymers used in the process of the invention can include homopolymers of any of the foregoing polymers, random copolymers, block copolymers, alternating copolymers, random tripolymers, block tripolymers, alternating tripolymers, derivatives thereof (e.g., salts, graft copolymers, esters, or ethers thereof), and the like. The polymer may be capable of being crosslinked in the presence of a multifunctional crosslinking agent.

Polymers employed in the process may be of any suitable molecular weight and molecular weight is not considered a limiting factor provided the process of the invention can be carried under high enough shear. The number average polymer molecular weight may range from a few hundred Dalton (e.g. 250 Da) to more several thousand Dalton (e.g. more than 10,000 Da), although any molecular weight could be used without departing from the invention. In some embodiments, the number average polymer molecular weight may be in the range of from about $1\times10^4$ to about $1\times10^7$. In one set of embodiments it may be desirable for the fibre-forming liquid to include a polymer of high molecular weight (for example, a number average molecular weight of at least $1\times10^5$) as higher molecular weight polymers may have favourable inter- and intra-chain entanglements which might help to stabilise the stream of fibre-forming liquid and promote filament and polymer fibre formation.

The fibre-forming liquid employed in the process of the invention may include a suitable amount of fibre-forming substance. Indeed, there is no upper limit to the amount of fibre-forming substance that may be used. In some embodiments, the fibre-forming liquid may include from about 0.1% (w/v) up to 100% (w/v) of fibre-forming substance.

When the fibre-forming liquid is a molten liquid, the liquid will generally be composed of neat fibre-forming substance. For instance, the molten liquid may be composed of neat polymer and/or neat polymer precursor.

When the fibre-forming liquid is a fibre-forming solution, the solution will generally contain a pre-determined quantity of fibre-forming substance. In some embodiments the amount of fibre-forming substance present in the fibre-forming solution may be range from about 0.1% (w/v) to 50% (w/v). In some embodiments, the fibre-forming solution contains an amount of fibre-forming substance in the range of from about 1 to 50% (w/v). In some embodiments, the fibre-forming solution contains an amount of fibre-forming substance in the range of from about 5 to 20%

(w/v). The fibre-forming substance is selected from the group consisting of a polymer, a polymer precursor, and combinations thereof. When the fibre-forming solution includes a mixture of two or more fibre-forming substances (such as a blend of two or more polymers, two or more polymer precursors, or a polymer and a polymer precursor), the total amount of fibre-forming substance in the fibre-forming solution may be in a range selected from the group consisting of from about 0.1% (w/v) to 50% (w/v), from about 1 to 50% (w/v), and from about 5 to 20% (w/v).

In some embodiments, fibre-forming solution is a polymer solution, the concentration of polymer in the polymer solution may range from about 0.1% (w/v) to 50% (w/v). In some embodiments, the polymer solution includes an amount of polymer in the range of from about 1 to 50% (w/v). In some embodiments, the polymer solution includes an amount of polymer in the range of from about 5 to 20% (w/v). One skilled in the relevant art would understand that when higher molecular weight polymers are used in a polymer solution, a lower polymer concentration may be employed while still achieving desirable polymer solution viscosities. In addition, the type of polymer may also influence polymer concentration. For example, polymers containing functional groups that can participate in inter- or intra-molecular interactions (e.g. hydrogen bonding) may provide polymer solutions of high viscosity at relatively low polymer concentrations. In general, the amount of polymer present in the polymer solution will depend on the type of polymer being utilised. When the polymer solution includes a mixture of two or more polymers, the total amount of polymer in the polymer solution may be in a range selected from the group consisting of from about 0.1% (w/v) to 50% (w/v), from about 1 to 50% (w/v), and from about 5 to 20% (w/v).

One benefit of the process described herein is that fibres can be formed with a wide range of fibre-forming liquids prepared with different polymers and/or polymer precursors and with different concentrations of polymer and/or polymer precursor.

In some embodiments, high polymer concentrations may be desirable in a polymer solution. High polymer concentrations may be in the range of from about 10 to 50% (w/v). A polymer solution containing a high quantity of polymer may exhibit slower gelation kinetics, allowing for longer filament lengths and increased tensile strength during shearing. High polymer content may also increase the viscosity of the polymer solution. Polymer solutions of high viscosity have the possibility to produce short nanofibres of regular diameter and length above certain shear rates. In some particular embodiments the amount of polymer in the polymer solution may be in the range of from about 10 to 20% (w/v).

In other embodiments, a low polymer content may be desirable in a polymer solution. A low polymer concentration may be in the range of from about 0.1 to 10% (w/v). In some particular embodiments the amount of polymer in the polymer solution may be in the range of from about 0.5 to 8% (w/v). The use of polymer solutions having a low quantity of polymer may be desirable when it is desired to produce polymer fibres of small diameter. For example, it has been found that silk fibres with diameters in the 100-200 nm range can be generated in high yield with a 2% silk fibroin solution. A decrease in fibre diameter with lower polymer concentration may be due to a reduction in filament diameter as a result of less polymer material being present in the polymer solution. A filament of low polymer content may also exhibit higher deformability under shear.

Fibre-forming liquids with low molecular weight polymers or having a low concentration of polymer may be subject to capillary instabilities due to a reduction in the viscosity ratio between the fibre-forming liquid and the dispersion medium. This can result in an increase in the rate of mass transfer of solvent or coagulant between the fibre-forming liquid and the dispersant and faster gelation and filament formation. However, it has been found that the effect of faster gelation and reduced viscosity may be counteracted by increasing the applied shear.

One skilled in the relevant art would appreciate that an appropriate polymer concentration and molecular weight may be selected to provide a fibre-forming liquid of the desired viscosity.

In one set of embodiments the fibre-forming liquid is a fibre-forming solution. The fibre-forming solution includes at least one fibre-forming substance dissolved or dispersed in a solvent. The fibre-forming substance may be selected from the group consisting of a polymer, a polymer precursor, and combinations thereof.

The polymer or polymer precursor may determine what solvent is used in the fibre-forming solution. Depending on the polymer or polymer precursor, the solvent may be selected from water, or from any suitable organic solvent. Organic solvents may belong to classes of oxygenated solvents (e.g., alcohols, glycol ethers, ketones, esters, and glycol ether esters), hydrocarbon solvents (e.g., aliphatic and aromatic hydrocarbons), and halogenated solvents (e.g., chlorinated hydrocarbons), subject to the compatibility and solubility requirements discussed herein.

In some embodiments, the solvent employed in the fibre-forming solution may be an aqueous solvent. This may be suitable when a water-soluble or water-dispersible polymer or polymer precursor is used. In one embodiment the fibre-forming solution may be an aqueous polymer solution including a water-soluble or water-dispersible polymer dissolved in an aqueous solvent. The aqueous solvent may be water, or water in admixture with a solvent, such as a water-soluble organic solvent (e.g. a $C_2$-$C_4$ alcohol). If necessary, the pH of the polymer solution may be adjusted by addition of a suitable acid or base to assist in solubilising the polymer.

In other embodiments, the fibre-forming solution includes an organic solvent. This may be suitable for organic solvent soluble polymers or polymer precursors. The fibre-forming solution may be an organic polymer solution including at least one organic solvent soluble polymer dissolved in an organic solvent. Organic solvents may include, but are not limited to, $C_5$ to $C_{10}$ alcohols (e.g. octanol, decanol), aliphatic hydrocarbons (e.g. pentane, hexane, heptane, dodecane), aromatic hydrocarbons (e.g. benzene, xylene, toluene), esters (e.g. ethyl acetate), ethers (e.g. triethylene glycol dimethyl ether, triethylene glycol diethyl ether), ketones (e.g. cyclohexanone) and oils (e.g. vegetable oil).

In yet other embodiments, the fibre-forming solution includes an ionic liquid and at least one fibre-forming substance dispersed in the ionic liquid. Preferably, the fibre-forming substance is a polymer.

In some embodiments, the fibre-forming solution may contain a mixture of two or more solvents. The two or more solvents may be miscible or at least partly soluble, and are capable of dissolving the selected fibre-forming substances. For example, an aqueous solvent may include a mixture of water and a water-soluble solvent. Exemplary water-soluble solvents may include, but are not limited to, acids (e.g. formic acid, acetic acid), alcohols (e.g. methanol, ethanol, isopropanol, butanol, ethylene glycol), aldehydes (e.g. formaldehyde), amines (e.g. ammonia, diisopropylamine, triethanolamine, dimethylamine, butylamine), esters (e.g. isopropyl ester, methyl propionate), ethers (e.g. diethyl ether), and ketones (e.g. acetone). In some embodiments, mixtures of solvents may influence interfacial tension and gelation rates by varying chemical potential.

In some embodiments the fibre-forming solution may include at least two or more solvents that are immiscible. For example, the fibre-forming solution may include a mixture of water and an organic solvent, such as a mixture of water and an oil. Such solvent mixtures can provide an avenue for forming fibres with a heterogeneous composition, which are composed of two or more fibre-forming substances (e.g. two or more polymers) having different solubility and physical properties.

It is one advantage of the invention that polymer fibres may be prepared from water-soluble or water-dispersible polymers as the process of the invention widens the choice of solvents that may be used. The possibility of forming polymer fibres, in particular, colloidal polymer nanofibres, from water soluble polymers offers a number of advantages for nanofabrication.

The dispersion medium employed in the process of the invention includes at least one solvent. In some embodiments, the dispersion medium may include two or more solvents. The dispersion medium can include any two or more solvents that are miscible or partially soluble. In some embodiments, when the dispersion medium includes a non-solvent as a coagulant for a fibre-forming substance contained in the fibre-forming liquid, the fibre-forming substance may be relatively insoluble, or completely insoluble, in the dispersion medium solvent. When the fibre-forming liquid is a fibre-forming solution, such as a polymer solution, it is desirable that the solvent of the fibre-forming solution be miscible with the solvent of the dispersion medium.

The term "insoluble" as used herein in relation to a fibre-forming substance means that the fibre-forming substance has a solubility in a solvent of less than 1 g/L at 25° C. in a selected solvent.

The term "miscible" as used herein in relation to two or more liquids refers to the ability of the liquids to dissolve in one another, regardless of the proportion of each liquid.

The term "partly soluble" or "partly miscible" as used herein in relation to two or more liquids refers to the ability of the liquids to dissolve in one another to a degree less than full miscibility. For example, a solvent of a fibre-forming solution may have a solubility in a dispersion medium solvent of at least 100 ml/L at 25° C.

The term "immiscible" as used herein in relation to two or more liquids means that the liquids have a solubility in one another of less than 100 ml/L at 25° C.

The dispersion medium may include at least one solvent selected from the group consisting of water, cryogenic liquids (e.g. liquid nitrogen) and organic solvents selected from classes of oxygenated solvents (e.g., alcohols, glycol ethers, ketones, esters, and glycol ether esters), hydrocarbon solvents (e.g., aliphatic and aromatic hydrocarbons), and halogenated solvents (e.g., chlorinated hydrocarbons). When the fibre-forming liquid is a polymer solution, the solvent of the dispersion medium is preferably miscible with the solvent of the polymer solution.

In some embodiments, the dispersion medium includes a solvent selected from the group consisting of protic solvents and non-protic solvents. In particular embodiments, the dispersion medium includes a solvent selected from the group consisting of water, an alcohol (e.g. $C_1$ to $C_{12}$ alcohols), an ionic liquid, a ketone solvent (e.g. acetone), and dimethyl sulfoxide. Mixtures of solvents may be used, for example, a mixture of water and alcohol.

In particular embodiments, the dispersion medium includes an alcohol. The dispersion medium may include at least 25% (v/v), at least 50% (v/v), or at least 75% (v/v) alcohol. Exemplary alcohols include $C_2$ to $C_4$ alcohols, such as ethanol, isopropanol and n-butanol. The viscosity of ethanol, isopropanol and n-butanol at room temperature are approximately 1.074 cP, 2.038 cP and 2.544 cP, respectively. Butanol is a desirably included in the dispersion medium in some embodiments as it is able to generate emulsions when in contact with water. In some embodiments, the alcohol may be volatile, having a low boiling point. A volatile solvent may be more easily removed from the polymer fibres after isolation of the fibres.

In some embodiments the dispersion medium may include an alcohol in admixture with at least one other solvent. The alcohol is preferably a $C_2$ to $C_4$ alcohol. In such embodiments the dispersion medium may include at least 25% (v/v), at least 50% (v/v), or at least 75% (v/v) alcohol.

In one set of embodiments it is preferred that the dispersion medium include no more than 50% (v/v), no more than 20% (v/v), no more than 10% (v/v), or no more than 5% (v/v) glycerol. In one set of embodiments it is a proviso of the process that the dispersion medium be substantially free of glycerol. It can be desirable to exclude glycerol from the dispersion medium as glycerol increases the viscosity of the dispersant and may be difficult remove from the formed fibres when it is desired to isolate the fibres.

In some embodiments the dispersion medium may be naturally occurring liquid derived from natural sources. The natural liquid may include a naturally occurring coagulant. An example of a natural liquid that may be used as a dispersion medium is milk, which contains calcium salts and which has been found to be useful as a dispersion medium for the formation of fibres from polymer solution containing sodium alginate.

In one set of embodiments the present invention provides a process for the preparation of polymer fibres including the steps of:

(a) introducing a stream of polymer solution including at least one polymer selected from the group consisting of polypeptides, alginates, chitosan, starch, collagen, silk fibroin, and polyacrylic acid into a dispersion medium including a $C_2$-$C_4$ alcohol and having a viscosity in the range of from about 1 to 100 centiPoise (cP);
(b) forming a filament from the stream of polymer solution in the dispersion medium; and
(c) shearing the filament under conditions allowing fragmentation of the filament and the formation of polymer fibres.

An important aspect of the process of the present invention is that the dispersion medium be of relatively low viscosity, with a viscosity in the range of from about 1 to 100 cP, and more specifically, a viscosity in the range of from about 1 to 50 cP, from about 1 to 30 cP, or from about 1 to 15 cP. One advantage of the use of a low viscosity dispersion medium is that it enables the fibres prepared by the process to be more easily purified or isolated from the dispersion medium. For example, polymer fibres may be isolated through the use of low centrifugal force to remove the dispersant, followed by evaporation of any remaining solvent. Other techniques for separating the fibres from the dispersion medium (e.g. filtration) may also be used. The ability to avoid complex or viscous dispersion media for the preparation of the fibres simplifies the cleaning or purification of the fibres and their subsequent isolation.

Once separated from the fibres, the dispersion medium employed in the process of the invention may be recycled or re-circulated to the apparatus, providing a more cost-effective manufacturing process.

Fibres isolated from a low viscosity dispersion medium can be readily re-suspended in solution (e.g. in aqueous media) or transferred to another solvent for further processing. In some embodiments, fibres prepared in accordance with the invention may be further processed by chemical modification and further functionalised for use in desired applications.

The mild processing conditions that may be used to isolate the fibres also provides the ability to retain the native characteristics of the fibre-forming substance. In the case of fibres prepared from natural polymers such as proteins or polypeptides, the fibres may retain the native characteristics of the polymer.

Furthermore, scalability of fibre formation and ease of use of the process of the invention is enhanced by the ability to avoid complex cleaning or purification procedures in order to isolate the formed fibres.

The process of the invention produces fibres using a low viscosity dispersion medium and a fibre-forming liquid of higher viscosity than the dispersion medium. The low viscosity dispersion medium facilitates formation of a stable stream of fibre-forming liquid, which solidifies into a filament that then fragments under shear to produce the polymer fibres. The process is in contrast with the process described in U.S. Pat. No. 7,323,540, which relies on initial formation of an emulsion (droplets) in a viscous glycerol-containing dispersant, then deformation and elongation of the droplets in the viscous dispersant under shear.

It is believed that the difference in the mechanism of polymer fibre formation between the process of the invention and that described in U.S. Pat. No. 7,323,540 is due to the relative viscosities of the dispersion medium and fibre-forming liquid employed in the present process, which can be represented as a viscosity ratio.

The present invention further provides fibres prepared by a process as described herein. In exemplary embodiments, fibres prepared by a process as described herein are polymer fibres. Fibres, such as polymer fibres, prepared in accordance with the present invention may be nanofibres or microfibres with diameters in the nanometer or micrometer range. In some embodiments, the fibres have a diameter in the range of from about 15 nm to about 5 μm. In some embodiments, the fibres may have a diameter in the range of from about 40 nm to about 5 μm, or from about 50 nm to about 3 μm. In some embodiments, the fibres may have a diameter in the range of from about 100 nm to about 2 μm. One advantage of the process of the present invention is that fibres having a controllable diameter may be formed. In some embodiments, the fibres have a monodisperse diameter. In other embodiments, fibres with bi-modal or multi-modal diameter distribution can be produced in one single experiment by varying either injection speed or shear rate during injection of the fibre-forming liquid in the dispersant.

In particular embodiments, the fibres prepared by the process are polymer fibres. Polymer fibres prepared in accordance with the present invention may have a diameter in a range selected from the group consisting of from about 15 nm to about 5 μm, from about 40 nm to about 5 μm, or from about 50 nm to about 3 μm. In some embodiments, the polymer fibres may have a diameter in the range of from about 100 nm to about 2 μm.

Fibres prepared by the process of the invention may have a lower distribution of fibre diameters (narrower polydispersity) than those prepared by prior art processes. In some embodiments, fibre diameters deviate no more than about 50%, preferably no more than about 45%, even more preferably no more than about 40%, from the average fibre diameter.

As discussed above, fibre diameter may be influenced by factors such as shear stress, the quantity of fibre-forming substance and temperature. These factors may be varied to obtain fibres of desired diameter. For example, a lower polymer concentration provides polymer fibres of smaller diameter, all other parameters being equal. The polydispersity of the fibres can be reduced by optimizing the experimental parameters described above.

The fibres formed in accordance with the present invention may be of any length, and a wide distribution of lengths can be obtained. In some embodiments, fibres produced in accordance with the process of the invention may have a length selected from the group consisting of at least about 1 μm, at least 100 μm, and at least 3 mm. In some embodiments the fibres may be colloidal fibres. Colloidal fibres are generally short fibres, and may have a length in the range of from about 1 μm to about 3 mm. The shear stress applied to the filament may affect the length of the resulting fibres, with high shear stress providing shorter fibre lengths. Fibre lengths may be adjusted by varying the operating parameters.

Fibres prepared in accordance with the invention are generally cylindrical in shape, and may be characterised and analysed using conventional techniques. For example, the morphology of the fibres may be analysed using optical microscopy or scanning electron microscopy.

In some embodiments, the fibres may include an additive. The additive may be introduced to the fibres by incorporating at least one additive in the fibre-forming liquid and/or the dispersion medium used to prepare the fibres. In some embodiments, the fibre-forming liquid further includes at least one additive. In embodiments where the fibre-forming liquid is a polymer solution, the polymer solution may further include at least one additive. In some embodiments, the dispersion medium further includes at least one additive. Exemplary additives that may be included in the fibre-forming liquid and/or dispersion medium include, without limitation, colorants (e.g. fluorescent dyes and pigments), odorants, deodorants, plasticizers, impact modifiers, fillers, nucleating agents, lubricants, surfactants, wetting agents, flame retardants, ultraviolet light stabilizers, antioxidants, biocides, thickening agents, heat stabilizers, defoaming agents, blowing agents, emulsifiers, crosslinking agents, waxes, particulates, flow promoters, coagulating agents (including: water, organic and inorganic acids, organic and inorganic bases, organic and inorganic salts, proteins, coordination complexes and zwitterions), multifunctional linkers (such as homo-multifunctional and hetero-multifunctional linkers) and other materials added to enhance processability or end-use properties of the polymeric components. Such additives can be used in conventional amounts.

In some embodiments, the additive may be a particle, such as for example, a nanoparticle or microparticle. In such embodiments the fibres may be composites. The particles may be silica or magnetic particles. The particles are retained by the fibres. In this context, a plurality of particles may be disposed on the outer surface of, and/or embedded in, and/or encapsulated by, the fibres. The particles may be included in the fibre-forming liquid and/or in the dispersion medium. In some embodiments, depending at least in part on the nature of the particles (e.g. size and/or composition of the particles), they may be introduced in the fibre-forming liquid, or they may be introduced into the dispersion medium separately from the fibre-forming liquid. The particles may be introduced into the fibre-forming liquid by mixing the particles in a fibre-forming solution containing a selected polymer and/or polymer precursor and a solvent. The particles may be present before or during shearing to form the fibres. In some embodiments, the particles may be introduced after shearing such as by being introduced into the dispersion medium while the as-formed fibres are resident in the dispersion medium, or by being added to the fibres by any suitable manner (e.g. coating, vapor deposition, etc.) after the fibres have been separated from the dispersion medium.

In some embodiments, when the fibre-forming liquid is a polymer solution including a water-soluble or water-dispersible polymer, the polymer solution may further include a water soluble nanoparticle. Different kinds of water soluble nanoparticles can be added to the polymer solution, such as quantum dots, metal oxides, other ceramic or metallic nanoparticles, and polymeric nanoparticles, and be used to modify the properties of the fibres. Polymer fibres incorporating such nanoparticles can thus store information such as colour, magnetic momentum and alignment, chemical composition, electrical conductivity, and can be further "written-on" in different ways (photo-bleaching, photo-etching, magnetisation, electrical poling).

In some embodiments, the fibres may be crosslinked. To form crosslinked fibres, crosslinking agents may be included in a fibre-forming solution and/or in the dispersion medium. Examples of crosslinking agents that may be used include glutaraldehyde, paraformaldehyde, homo-bifunctional or hetero-bifunctional organic crosslinkers, and multi-valent ions such as $Ca^{2+}$, $Zn^{2+}$, $Cu^{2+}$. The selection of crosslinking agent may depend on the nature of the fibre-forming substance used to the form the fibres. Crosslinking of the as-formed fibres resident in the dispersion medium may occur by suitable initiation of the crosslinking reaction, for example, by addition of an initiator molecule or by exposure to an appropriate wavelength of radiation, such as UV light. Crosslinking of the fibres can be useful to improve the stability of the fibres such that they can be readily transferred from one medium to another if desired. Suitable crosslinking performed during formation of the fibres or post-synthesis may also allow for the preparation of colloidal hydrogel fibres.

Referring now to FIG. 1, one embodiment of the process of the invention for preparing fibres is shown. In this embodiment, a viscous fibre-forming liquid is injected with velocity (V1) into the dispersion medium under shear as a first step. The properties of the viscous fibre-forming liquid and the interfacial tension between the fibre-forming liquid and the dispersion medium are such that the fibre-forming liquid can be maintained as a continuous flow when exposed to the dispersion medium. The applied shear force (F1) accelerates the stream of fibre-forming liquid from its injection velocity (V1) to the local velocity of the sheared dispersion medium (V2), leading to stretching of fibre-forming liquid. In a second step of the process, the stream of fibre-forming liquid forms a filament. The filament may be a gelled filament if the stream of fibre-forming liquid begins to solidify due to the solvent attrition from the fibre-forming liquid into the surrounding dispersion medium. Formation of a gelled filament can occur in a matter of seconds after exposure of the fibre-forming liquid to the dispersion medium. The gelation can help to ensure that the stream of fibre-forming liquid does not break up into droplets. Once the filament is formed, and the applied shear force (F1) overcomes the tensile strength of the filament under shear, the filament breaks into segments of length L, which constitute the fibres. In some instances, secondary break up may also occur, leading to shorter lengths for the fibres.

The process of the invention is flexible and allows control over fibre sizes, aspect ratio, and polydispersity. The process of the invention offers the advantage of being simple and scalable. The process of the invention can be used to prepare large amounts of fibres in an inexpensive way using basic laboratory or industrial equipment. The process of the invention may be carried out in a batch or continuous process. The process of the invention may be completed in a matter of minutes, depending upon the scale.

The process of the invention may also allow fabrication of multicomponent fibres if a stream of fibre-forming liquid including at least two different fibre-forming substances (e.g. two different polymers) is introduced into the dispersion medium. Depending on the density and/or miscibility of the polymers, the polymers may each form a separate and discrete phase within the fibre-forming liquid. The filament formed with the fibre-forming liquid and the resulting fibres may then have a multicomponent composition that reflects the distribution of the fibre-forming substances in the fibre-forming liquid. In some embodiments, the multicomponent fibres may be bicomponent fibres. Bicomponent fibres may be formed when a fibre-forming liquid including two polymers of different density or miscibility is used. To form bicomponent fibres, the two polymers may be bilaterally separated in the stream of fibre-forming liquid.

Fibres prepared in accordance with the process of the invention may be processed or used as needed to fabricate any desired end-product for use in a number of applications. Such applications include, but are not limited to, biomaterials for tissue engineering, smart adhesives, ultra-filtration membranes, stabilized foams, optical bar-coding, drug delivery, and single-nanofibre based sensors and actuators.

In some embodiments, the fibres may be used to produce non-woven webs or mats for various applications. For example, non-woven mats including polymer fibres may be used in biomaterials applications by applying the non-woven mat to a surface of a biomaterial, for example, a tissue engineering scaffold. Non-woven mats including the polymer fibres may also be used in filtration or printing applications.

In another aspect, the present invention provides an article including the fibres prepared in accordance with embodiments of the invention applied to a surface of the article. The article may be a medical device or a substance for use in a medical device, such as a biomaterial.

In another aspect, the present invention provides suspension including fibres prepared in accordance with embodiments of a process of the invention described herein.

EXAMPLES

The following examples illustrate the present invention in further detail however the examples should by no means be construed as limiting the scope of the invention as described herein.

equipped with high shear impeller was used in the procedure. The stirring head was inserted in a beaker of similar diameter. The dispersing solvent was first introduced in the beaker, the stirring was started and 3 ml of the polymer solution were then quickly injected in the gap between the mixer's head and the wall of the beaker by using a 3 mL syringe with a 27G needle, injection speed: 20 mL/min. Stirring was maintained for a certain time then stopped. The samples were rinsed with precipitating medium (n-butanol) and characterized.

The samples were characterized by Scanning Electron Microscopy and Optical Microscopy (Olympus DP70). The average length and diameter of the produced nanofibres were calculated by measuring over 200 fibres and processing and plotting the data using Origin8™ SR4 (Origin Labs Corp.).

The results obtained from varying different process parameters are shown in Table 1.

TABLE 1

| Example No | Sample Name | Initial Temp of Non-solvent | Polymer Conc (% w/v) | Stirring Speed (rpm) | Vol. polymer solution (ml) | Median Fibre Diameter (nm) | Average Fibre Diameter (nm) | Median Fibre Length (μm) | Average Fibre Length (μm) |
|---|---|---|---|---|---|---|---|---|---|
| 1 | BSM1/2 | 0° C. | 12 | 8800 | 3 | 644 | 640 | 10.08 | 11.13 |
| 2 | BSM3 | R.T. | 6 | 10000 | 3 | 228 | 301 | 6.21 | 7.56 |
| 3 | BSM4 | 0° C. | 6 | 8800 | 3 | 271 | 294 | 7.31 | 5.12 |
| 4 | BSM5 | R.T. | 4 | 8800 | 6 | 616 | 614 | 8.91 | 9.67 |
| 5 | BSM6 | 0° C. | 3 | 8800 | 6 | 303 | 337 | 4.95 | 5.86 |
| 6 | BSM10 | R.T. | 12.6 | 6400 | 3 | 586 | 606 | 11.77 | 15.03 |
| 7 | BSM11 | R.T. | 12.6 | 4000 | 3 | 515 | 550 | 31.02 | 36.81 |
| 8 | BSM12 | R.T. | 3 | 6400 | 3 | 113 | 125 | 3.02 | 3.58 |
| 9 | BSM13 | R.T. | 3 | 4000 | 3 | 269 | 287 | 4.50 | 5.91 |

R.T. = room temperature

General Experimental Procedure

A polymer solution is prepared by dissolving a desired quantity of polymer in a solvent with stirring. If necessary, the solution may be treated with heat, acid or base to assist with solubilisation of the polymer.

A volume of a selected dispersion medium (250-400 ml) is introduced in a suitable container in which the shearing head of a high-speed mixer (for instance: T50 UltraTurrax-IKA, equipped with high shear impeller) is then immersed.

After the stirring has started, a desired volume of fibre-forming liquid (for example, 3-5 ml) is introduced by means of injection (i.e. using a syringe pump) in the gap between the mixer's head and the wall of the beaker. In the reported examples, a 3 mL syringe with a 23G needle was used to inject the fibre-forming liquid, and the injection speed was varied. Stirring is to be maintained for a certain time then stopped. The samples are rinsed with precipitating medium, or other non-solvent and characterized.

If desired, the dispersion medium, container, stirrer, and optionally also the fibre-forming liquid, may be cooled (e.g. by freezing) to allow the fibre-forming process to be carried out at temperature below room temperature.

Preparation of Poly(Ethylene-Co-Acrylic Acid) (PEAA) Fibres

A 20% wt/vol solution of poly(ethylene-co-acrylic acid) (PEAA) (DowChemical, Primacor™ 59901) was prepared in diluted ammonia (9% ammonia in water), stirring overnight at 95° C. This solution was then diluted with pH 12 aqueous ammonia, to prepare solutions of varying polymer concentration. 1-butanol was chosen as the dispersing solvent (250 ml). A high speed mixer (T50 UltraTurrax-IKA)

Results and Discussion

A basic procedure for producing polymer fibres is depicted in FIG. 1.

Figure 2:
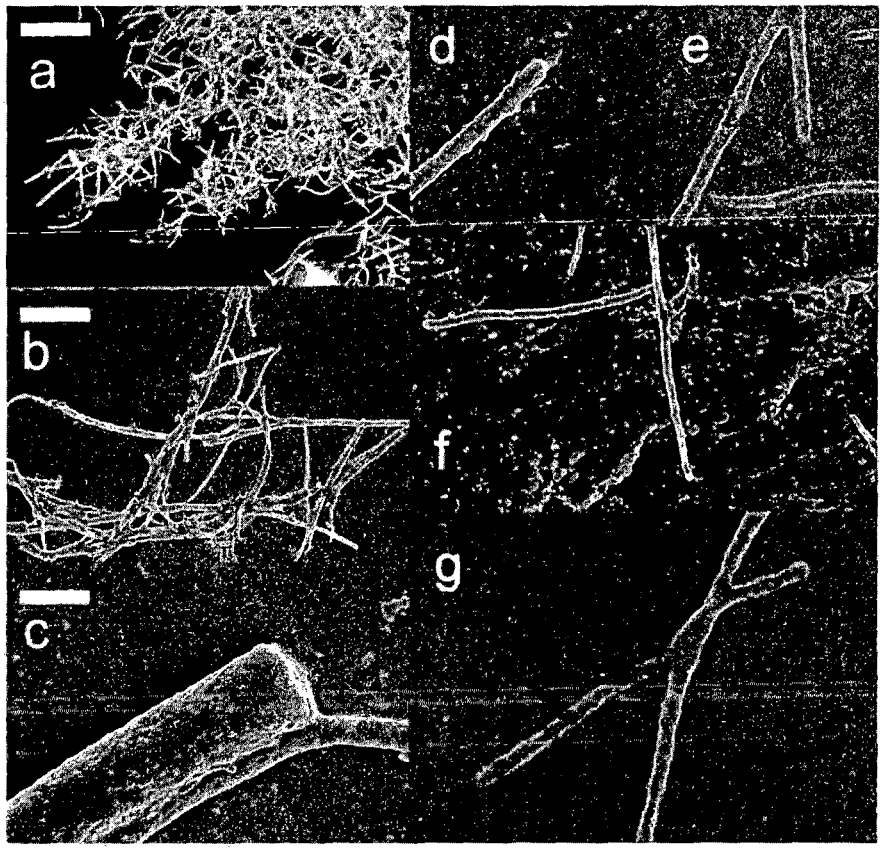
FIG. 2 shows (a) an optical microscopy image, and (b)-(g) scanning electron microscopy images of fibres prepared under shear in accordance with one embodiment of the invention. The scale bars are: (a) 20 μm, (b) 5 μm and (c) 1 μm.

FIG. 2 shows (a) an optical microscopy image, and (b-g) scanning electron microscopy images of typical precipitates collected after injection of PEAA solutions in n-butanol under shear. The scale bars are: (a) 20 μm, (b) 5 μm and (c) 1 μm. As seen in FIG. 2(*a*) a plurality of short polymer nanofibres are obtained. As seen in FIG. 2 (*c*) the nanofibres present cylindrical shape. As seen in FIGS. 2 (*d*) to (*g*) the tip of the produced nanofibres is non-sharp and semi-rounded.

Figure 3:
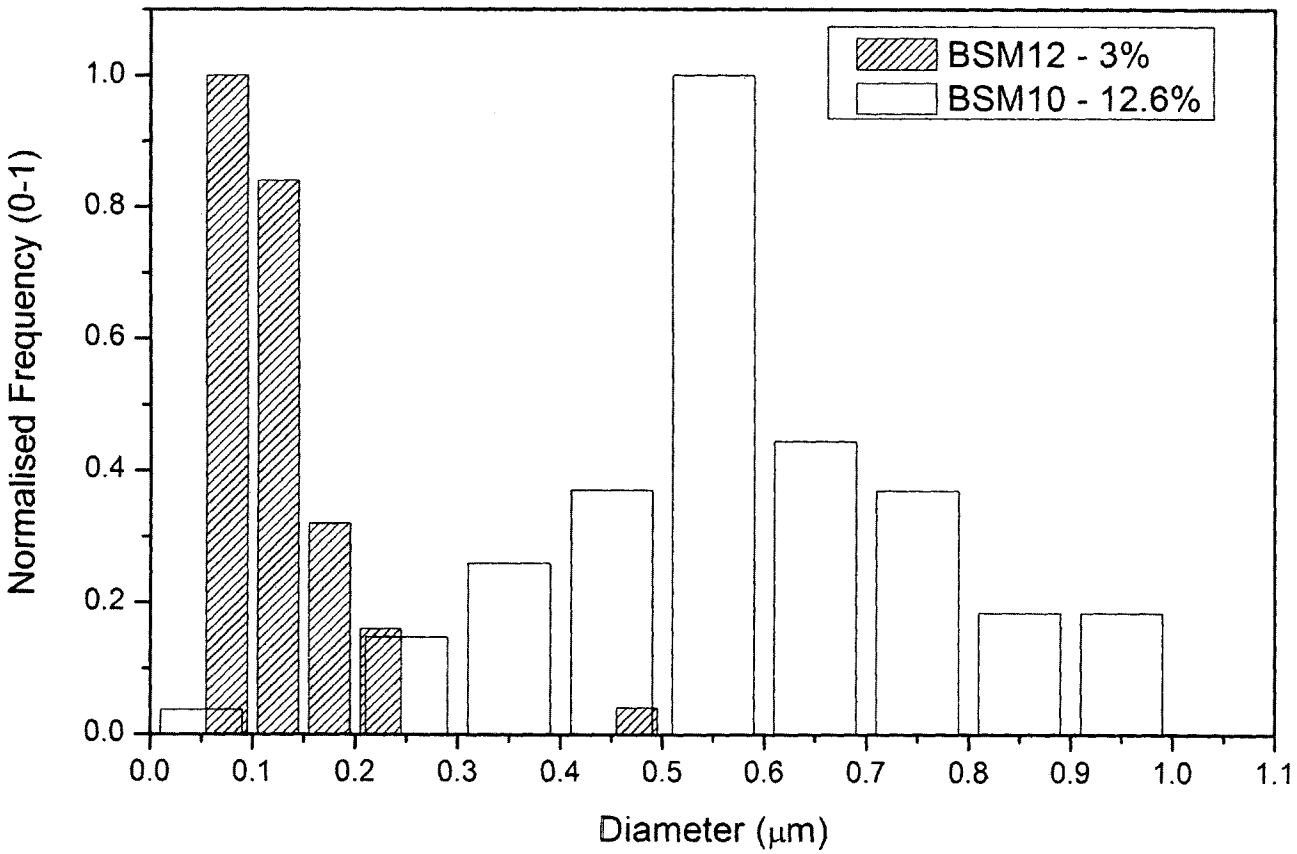
FIG. 3 is a graph showing the distribution of fibre diameter for fibres produced with fibre-forming solutions containing different concentrations of polymer in accordance with embodiments of the invention.

FIG. 3 shows the distribution of the diameter of the polymer nanofibres produced with different PEAA concentrations (stirring speed 6400 rpm; time 7 min; 250 ml of n-butanol; 3 ml of polymer solution; room temperature).

Figure 4A:
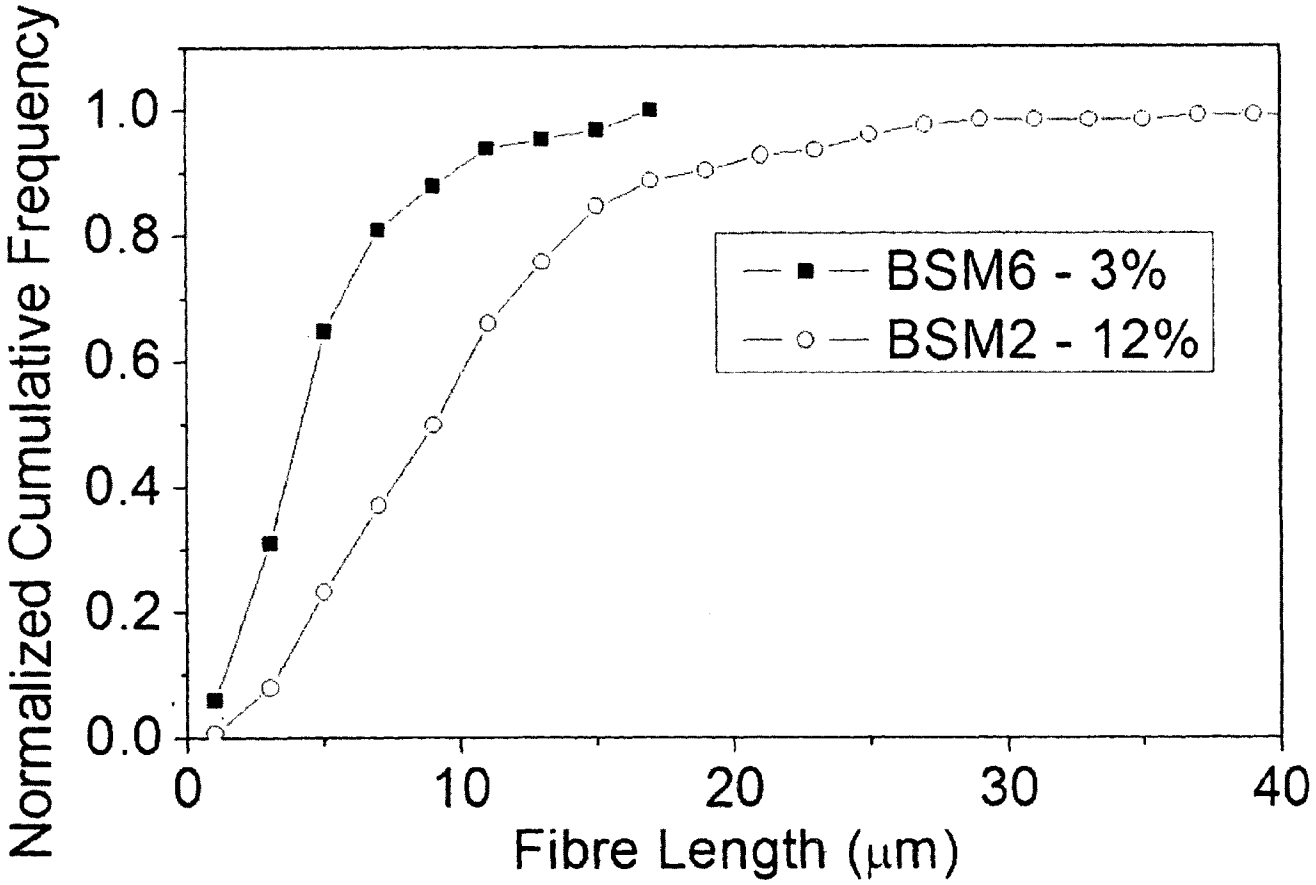
FIG. 4 shows graphs comparing the distribution of fibre length with various processing parameters in accordance with embodiments of the invention, with (a) showing the effect of the polymer concentration on the measured fibre length, and (b) and (c) showing the effect of the stirring speed on fibre length for a low concentration polymer solution (3% wt/vol) and a high concentration polymer solution (12.6% wt/vol), respectively.
Figure 4B:
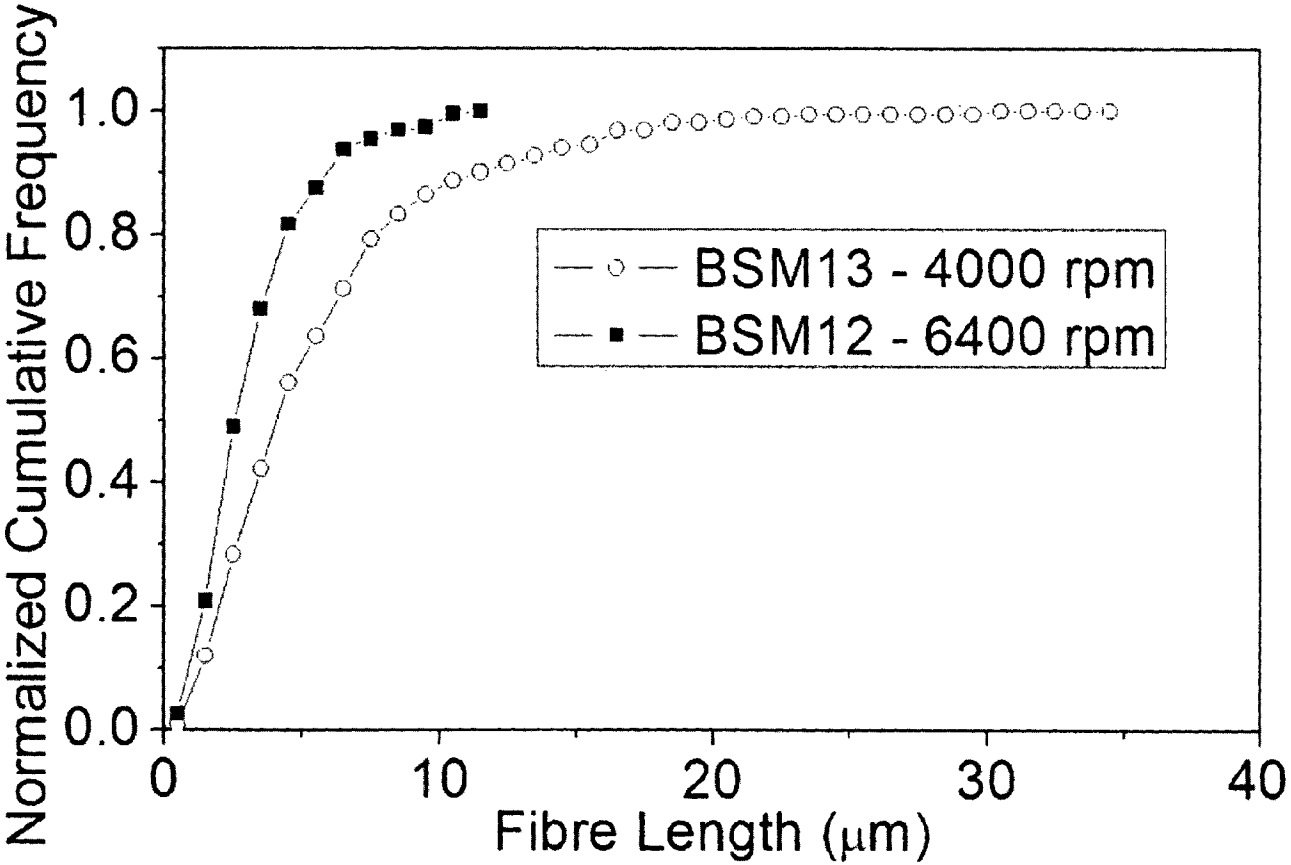
Figure 4C:
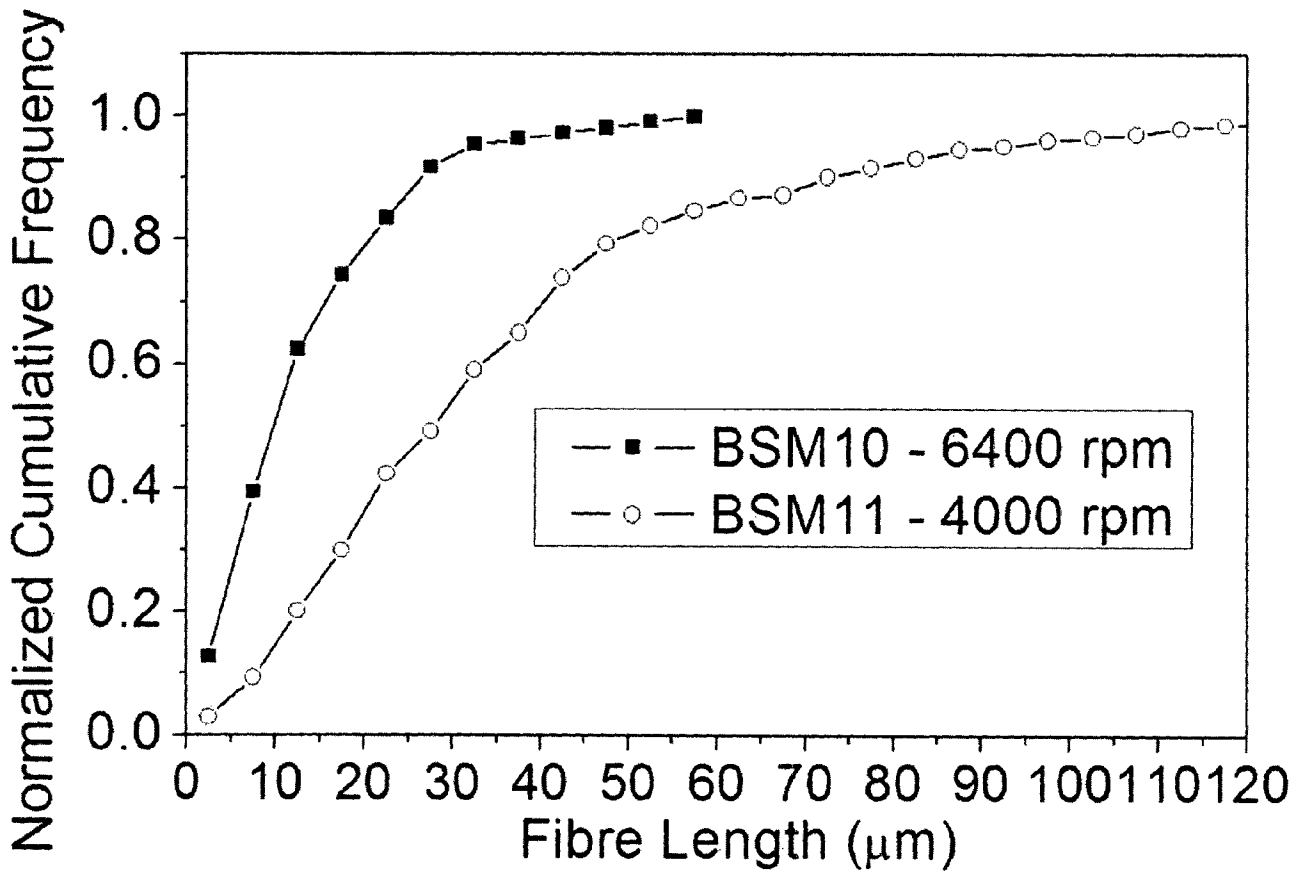

FIG. 4 shows graphs comparing the distribution of fibre length with varying processing parameters. The cumulative frequency of data within length intervals was calculated and plotted for visualization. FIG. 4(*a*) shows the effect of the polymer concentration on the measured fibre length (stirring speed 8800 rpm). FIGS. 4(*b*) and 4(*c*) shows the effect of the stirring speed on fibre length for a low concentration polymer solution (3% wt/vol) and a high concentration polymer solution (12.6% wt·vol), respectively.

The Experimental Procedure described above for the preparation of PEAA fibres was used to prepare PEAA fibres under various processing conditions, as described in Table 2.

TABLE 2

Preparation of PEAA nanofibres under various process conditions.

| Example | Polymer conc. (% w/v) | Viscosity (cP) | Stirring speed (rpm) | Temp (° C.) | Mean Fibre diameter (nm) | Median Fibre diameter (nm) | Median Fibre length (μm) |
|---|---|---|---|---|---|---|---|
| 10 | 12 | ~30 | 8800 | −16 | 699 | 693 | — |
| 11 | 12 | ~30 | 8800 | −16 | 559 | 559 | 10.08 |
| 12 | 6 | <10 | 10000 | 22 | 301 | 228 | 8.49 |
| 13 | 6 | <10 | 8800 | −16 | 295 | 271 | 5.12 |
| 14 | 4 | <10 | 8800 | 22 | 613 | 616 | 8.98 |
| 15 | 3 | <10 | 8800 | −16 | 337 | 304 | 4.95 |
| 16 | 12.6 | ~30 | 6400 | 22 | 635 | 586 | 11.77 |
| 17 | 12.6 | ~30 | 4000 | 22 | 549 | 515 | 31.02 |
| 18 | 3 | <10 | 6400 | 22 | 125 | 113 | 3.49 |
| 19 | 3 | <10 | 4000 | 22 | 287 | 269 | 4.49 |
| 20 | 6 | <10 | 4000 | 22 | 423 | 417 | — |
| 21 | 6 | <10 | 6400 | 22 | 383 | 357 | — |
| 22 | 6 | <10 | 10000 | −16 | 202 | 189 | — |
| 23 | 6 | <10 | 6400 | −16 | 295 | 286 | — |
| 24 | 6 | <10 | 4000 | −16 | 244 | 238 | — |
| 25 | 8 | ~15 | 4000 | 22 | <300 | <300 | — |
| 26 | 8 | ~15 | 6400 | 22 | 284 | 249 | 6.31 |
| 27 | 8 | ~15 | 10000 | 22 | 255 | 240 | 6.61 |
| 28 | 8 | ~15 | 4000 | −16 | 343 | 313 | 6.23 |
| 29 | 8 | ~15 | 6400 | −16 | 272 | 253 | 4.76 |
| 30 | 8 | ~15 | 10000 | −16 | 204 | 189 | 3.59 |
| 31 | 2 | <10 | 10000 | −16 | <150 | <150 | — |
| 32 | 2 | <10 | 6400 | −16 | <250 | <250 | — |
| 33 | 12 | ~30 | 10000 | 22 | 435 | 408 | — |
| 34 | 20 | ~45 | 10000 | 22 | 923 | 867 | — |
| 35 | 20 | ~45 | 6400 | 22 | 1680 | 1578 | — |
| 36 | 20 | ~45 | 4000 | 22 | 1076 | 1017 | — |
| 37 | 20 | ~45 | 4000 | −16 | 753 | 717 | — |
| 38 | 20 | ~45 | 10000 | −16 | 659 | 598 | — |
| 39 | 20 | ~45 | 6400 | −16 | 894 | 842 | — |
| 40 | 12 | ~30 | 6400 | −16 | 433 | 421 | — |
| 41 | 12 | ~30 | 4000 | −16 | 440 | 421 | — |

— indicates that the length was not measured

Figure 5A:
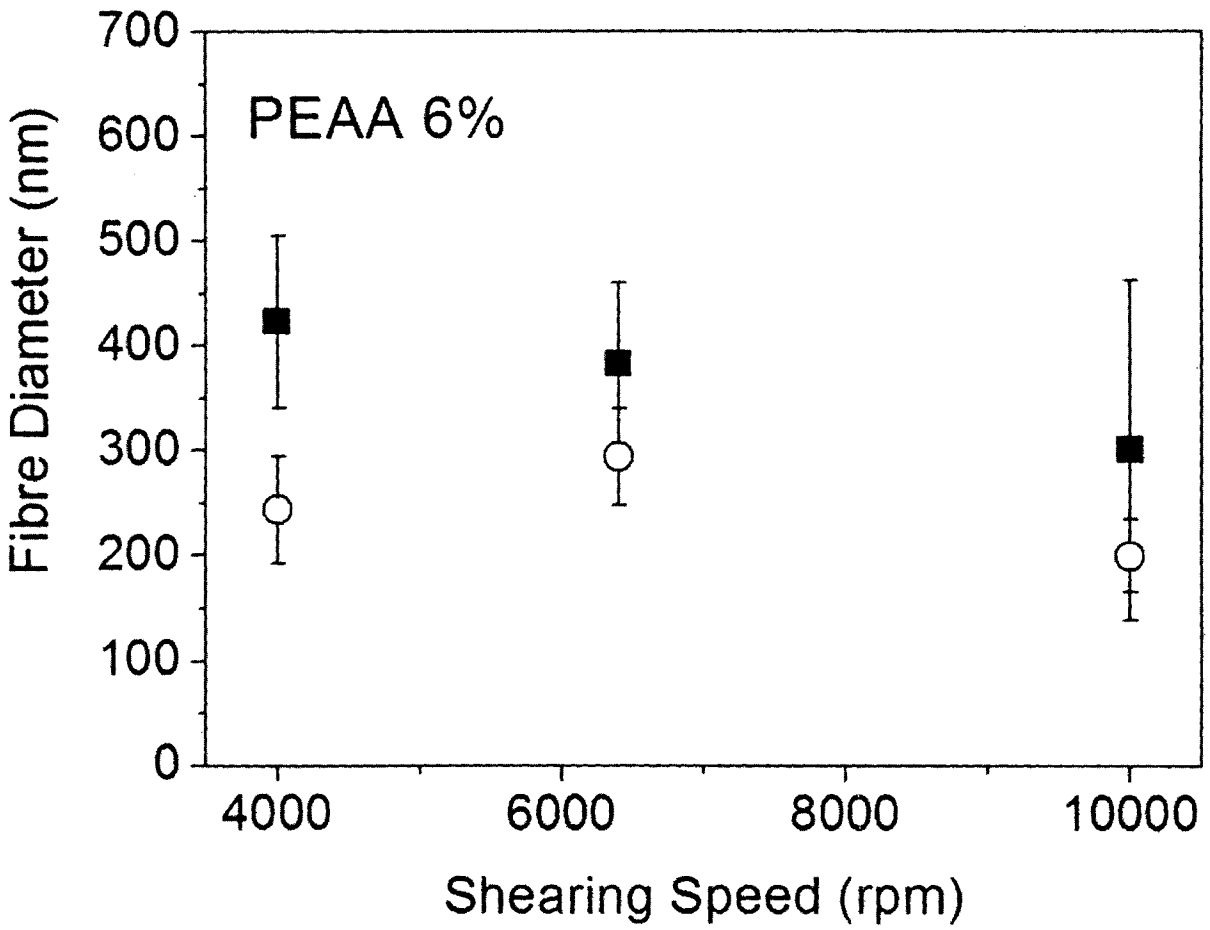
FIG. 5 shows graphs illustrating average fibre diameters obtained when polymer solutions containing (a) 6% (w/v) PEAA, (b) ~12% (w/v) PEAA and (c) 20% (w/v) PEAA are processed at either a low temperature of between −20° C. to 0° C. (open circles) or at room temperature of approximately 22° C. (closed squares), at different shearing speeds.
Figure 5B:
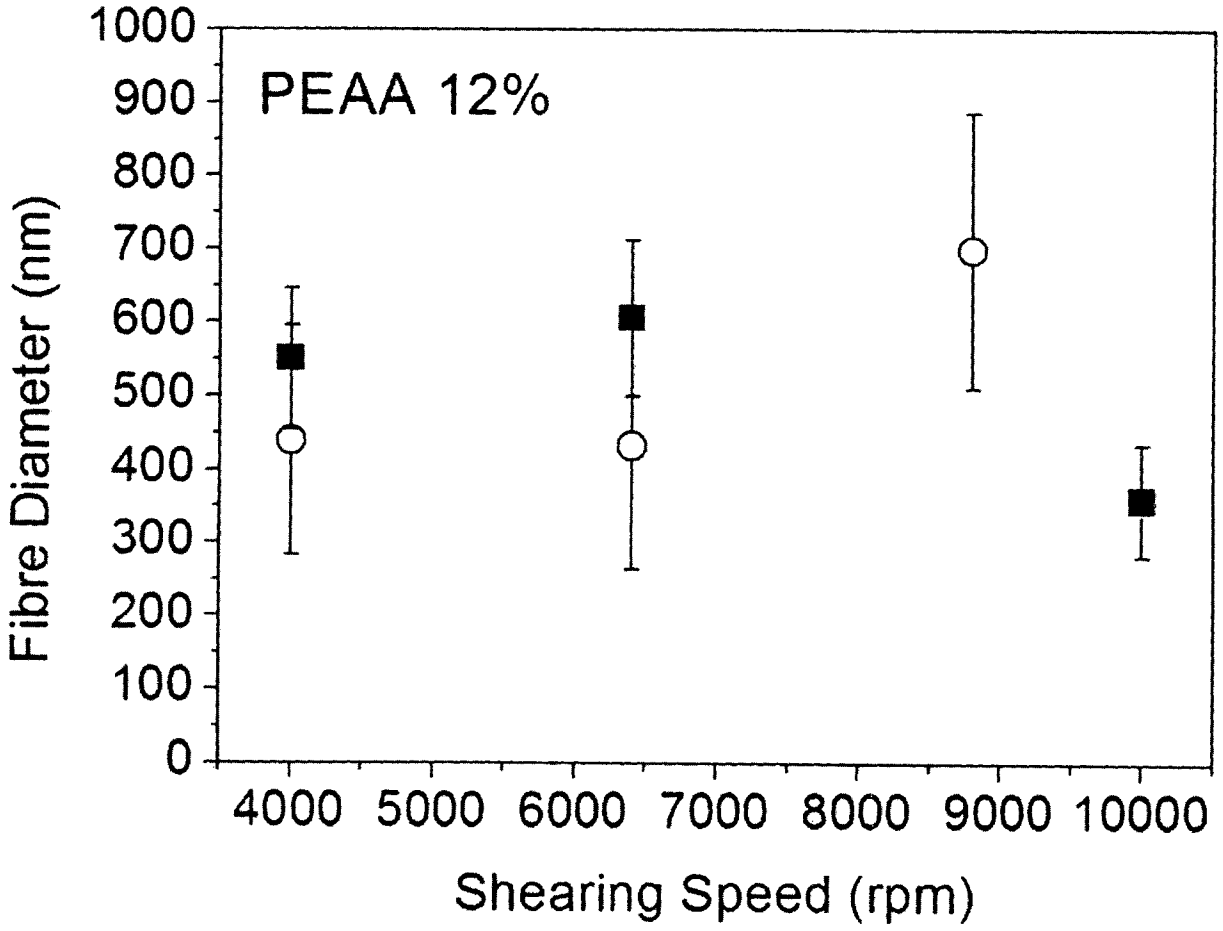
Figure 5C:
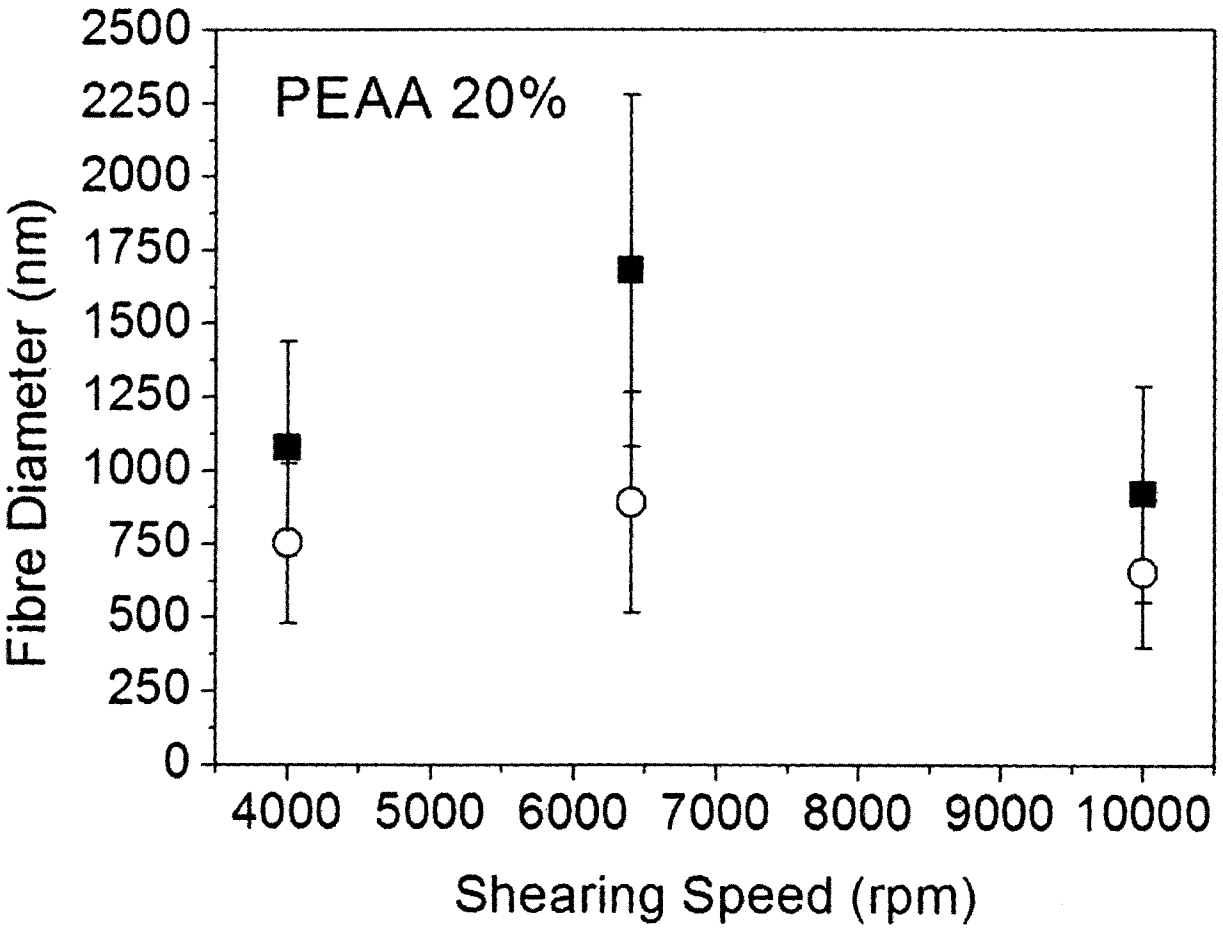

FIG. 5 shows graphs illustrating average fibre diameters obtained when polymer solutions containing (a) 6% (w/v) PEAA, (b) ~12% (w/v) PEAA and (c) 20% (w/v) PEAA are processed at either a low temperature of between −20° C. to 0° C. (open circles) or at room temperature of approximately 22° C. (closed squares), at different shearing speeds. In general, fibre diameter was observed to increase with increasing polymer concentration. In addition, processes conducted at low temperature yielded fibres with smaller diameter than the corresponding process conducted at room temperature.

The General Experimental Procedure above was used to prepare polymer fibres with different polymers under various processing conditions, as described in Tables 3 and 4.

TABLE 3

Preparation of polymer fibres with different polymers and dispersion medium at different processing conditions

| Example | Polymer | Polymer conc. (% w/v) | Polymer solution solvent | Injection Speed | Dispersion medium | Stirring speed (rpm) | Temp (° C.) | Mean Fibre diameter (nm) | Median Fibre length (μm) |
|---|---|---|---|---|---|---|---|---|---|
| 42 | Polystyrene | 2% | acetone | ~1 mL/10 sec | 1-butanol/ glycerol (1:1) | 10000 | R.T. | <500 | >25 |
| 43 | Poly(acrylic acid) | 5% | aq. ammonia, pH 11 | ~1 mL/10 sec | 1-butanol | 10000 | R.T. | >800 | >45 |
| 44 | Poly(acrylic acid) | 0.5% | aq. ammonia, pH 11 | ~1 mL/2 sec | 1-butanol | 10000 | R.T. | <250 | >20 |
| 45 | Poly(lactic acid) | 4% | 1,4-dioxane | ~1 mL/10 sec | ethanol | 4000 | R.T. | >900 | >35 |
| 46 | Poly(lactic acid) | 4% | 1,4-dioxane | ~1 mL/10 sec | ethanol | 10000 | R.T. | >700 | >20 |
| 47 | Silk fibroin | 8% | water | ~1 mL/10 sec | 1-butanol | 4000 | R.T. | <2800 | >300 |
| 48 | Silk fibroin | 8% | water | ~1 mL/5 sec | 1-butanol | 6400 | R.T. | <2400 | >300 |
| 49 | Silk fibroin | 8% | water | ~1 mL/5 sec | 1-butanol | 10000 | R.T. | <2600 | >300 |
| 50 | Silk fibroin | 6.15% | water | ~1 mL/5 sec | 1-butanol | 6400 | R.T. | <900 | >100 |
| 51 | Silk fibroin | 6.15% | water | ~1 mL/5 sec | 1-butanol | 10000 | R.T. | <400 | >40 |
| 52 | Silk fibroin | 4% | water | ~1 mL/5 sec | 1-butanol | 4000 | R.T. | <600 | >25 |
| 53 | Silk fibroin | 4% | water | ~1 mL/10 sec | 1-butanol | 6400 | R.T. | <400 | >10 |
| 54 | Silk fibroin | 4% | water | ~1 mL/5 sec | 1-butanol | 10000 | R.T. | <400 | >20 |
| 55 | Silk fibroin | 3.1% | water | ~1 mL/5 sec | 1-butanol | 6400 | R.T. | <600 | >10 |

TABLE 3-continued

Preparation of polymer fibres with different polymers and dispersion medium at different processing conditions

| Example | Polymer | Polymer conc. (% w/v) | Polymer solution solvent | Injection Speed | Dispersion medium | Stirring speed (rpm) | Temp (° C.) | Mean Fibre diameter (nm) | Median Fibre length (μm) |
|---|---|---|---|---|---|---|---|---|---|
| 56 | Silk fibroin | 3.1% | water | ~1 mL/5 sec | 1-butanol | 10000 | R.T. | <200 | >10 |
| 57 | Silk fibroin | 2% | water | ~1 mL/5 sec | 1-butanol | 4000 | R.T. | <400 | >20 |
| 58 | Silk fibroin | 2% | water | ~1 mL/5 sec | 1-butanol | 6400 | R.T. | <350 | >15 |
| 59 | Silk fibroin | 2% | water | ~1 mL/5 sec | 1-butanol | 10000 | R.T. | <250 | >5 |

TABLE 4

Preparation of polymer fibres with different polymers and dispersion medium at different processing conditions

| Example No. | Polymer Solution (% w/v) | Viscosity (cP) | Polymer solution solvent | Injection Speed | Dispersion medium | Stirring speed (rpm) | Temp (° C.) | Median Fibre diameter (μm) | Average Fibre Diameter (μm) | Average Fibre Diameter Std Dev (μm) | Median Fibre length (μm) |
|---|---|---|---|---|---|---|---|---|---|---|---|
| 60 | PEAA (16.8%) | ~38 | 9% aq. ammonia | 9999 mL/hr | 1-butanol | 4000 | −20 | 0.704 | 0.782 | 0.224 | 17.44 |
| 61 | PEAA (16.8%) | ~38 | 9% aq. ammonia | 9999 mL/hr | 1-butanol | 6400 | −20 | 0.699 | 0.72 | 0.12 | 28.13 |
| 62 | PEAA (16.8%) | ~38 | 9% aq. ammonia | 9999 mL/hr | 1-butanol | 10000 | −20 | 0.660 | 0.632 | 0.146 | 10.74 |
| 63 | PEAA (16.8%) | ~38 | 9% aq. ammonia | 5000 mL/hr | 1-butanol | 4000 | −20 | 0.701 | 0.753 | 0.248 | 22.79 |
| 64 | PEAA (16.8%) | ~38 | 9% aq. ammonia | 5000 mL/hr | 1-butanol | 10000 | −20 | 0.665 | 0.675 | 0.175 | 28.61 |
| 65 | PEAA (16.8%) | ~38 | 9% aq. ammonia | 2500 mL/hr | 1-butanol | 4000 | −20 | 1.622 | 1.708 | 0.599 | 52.21 |
| 66 | PEAA (16.8%) | ~38 | 9% aq. ammonia | 2500 mL/hr | 1-butanol | 10000 | −20 | 1.28 | 1.412 | 0.397 | 41.7 |
| 67 | Silk (5.4%) | | water | 9999 mL/hr | 1-butanol | 4000 | −20 | 0.457 | 0.483 | 0.193 | 60.66 |
| 68 | Silk (5.4%) | | water | 9999 mL/hr | 1-butanol | 6400 | −20 | 0.354 | 0.492 | 0.311 | 72.02 |
| 69 | Silk (5.4%) | | water | 9999 mL/hr | 1-butanol | 10000 | −20 | 0.439 | 0.441 | 0.104 | 42.85 |
| 70 | Silk (5.4%) | | water | 2500 mL/hr | 1-butanol | 4000 | −20 | 0.396 | 0.475 | 0.168 | 20.49 |
| 71 | Silk (5.4%) | | water | 2500 mL/hr | 1-butanol | 6400 | −20 | 0.569 | 0.606 | 0.265 | 59.66 |
| 72 | Silk (5.4%) | | water | 2500 mL/hr | 1-butanol | 10000 | −20 | 0.427 | 0.458 | 0.151 | 53.51 |
| 73 | Silk (3.5%) | | water | 9999 mL/hr | 1-butanol | 4000 | −20 | 0.39 | 0.437 | 0.175 | 46.46 |
| 74 | Silk (3.5%) | | water | 9999 mL/hr | 1-butanol | 6400 | −20 | 0.630 | 0.622 | 0.13 | 42.67 |
| 75 | Silk (3.5%) | | water | 9999 mL/hr | 1-butanol | 10000 | −20 | 0.349 | 0.391 | 0.136 | 37.57 |
| 76 | Silk (3.5%) | | water | 2500 mL/hr | 1-butanol | 4000 | −20 | 0.343 | 0.346 | 0.097 | 52.11 |
| 77 | Silk (3.5%) | | water | 2500 mL/hr | 1-butanol | 6400 | −20 | 0.479 | 0.542 | 0.224 | 28.67 |
| 78 | Silk (3.5%) | | water | 2500 mL/hr | 1-butanol | 10000 | −20 | 0.318 | 0.332 | 0.111 | 26.94 |
| 79 | Silk (2%) | | water | 9999 mL/hr | 1-butanol | 4000 | −20 | 0.408 | 0.462 | 0.191 | 23.46 |
| 80 | Silk (2%) | | water | 9999 mL/hr | 1-butanol | 10000 | −20 | 0.371 | 0.4 | 0.158 | 30.16 |
| 81 | Silk (2%) | | water | 2500 mL/hr | 1-butanol | 4000 | −20 | 0.294 | 0.309 | 0.083 | 30.56 |
| 82 | Silk (2%) | | water | 2500 mL/hr | 1-butanol | 10000 | −20 | 0.303 | 0.344 | 0.121 | 14.13 |
| 83 | PAA* (5%) | ~45 | water | ~1 mL/10 sec | 1-butanol | 6400 | −20 | 1.274 | 1.158 | 0.323 | 31.29 |
| 84 | PAA* (2%) | ~20 | water | ~1 mL/5 sec | 1-butanol | 10000 | −80 | 0.656 | 0.622 | 0.292 | 23.97 |
| 85 | PAA* (1%) | <10 | water | ~1 mL/5 sec | 1-butanol | 10000 | −20 | 0.311 | 0.33 | 0.111 | 35.27 |
| 86 | Gelatine (food grade) (2%) | | water | ~1 mL/10 sec | 1-butanol | 6400 | 21 | 0.440 | 0.47 | 0.182 | 22.25 |

TABLE 4-continued

Preparation of polymer fibres with different polymers and dispersion medium at different processing conditions

| Example No. | Polymer Solution (% w/v) | Viscosity (cP) | Polymer solution solvent | Injection Speed | Dispersion medium | Stirring speed (rpm) | Temp (° C.) | Median Fibre diameter (μm) | Average Fibre Diameter (μm) | Average Fibre Diameter Std Dev (μm) | Median Fibre length (μm) |
|---|---|---|---|---|---|---|---|---|---|---|---|
| 87 | Chitosan (medium MW) (2%) | | 10% aq. acetic acid | ~1 mL/10 sec | 1-butanol | 6400 | −20 | 0.287 | 0.285 | 0.091 | 29.76 |
| 88 | Chitosan (low MW) (2%) | | 10% aq. acetic acid | ~1 mL/10 sec | 1-butanol | 6400 | −20 | 0.278 | 0.293 | 0.053 | 81.83 |

*PAA = Poly(acrylic acid), MW 450,000

The results of Table 3 and Table 4 show that fibres can be produced with a range of polymers, including synthetic polymers and natural polymers.

Example 89

Preparation of Poly(Ethylene-Co-Acrylic Acid) (PEAA) Fibres with Magnetic Nanoparticles A 20% wt/vol solution of poly(ethylene-co-acrylic acid) (PEAA) (DowChemical, Primacor™ 59901) was prepared in diluted ammonia (9% ammonia in water), stirring overnight at 95° C. Magnetic nanoparticles were then added to this solution, and then diluted with pH 12 aqueous ammonia to a final solution concentration of 8% (w/v) PEAA. 1-butanol (250 ml) was added to the beaker of a high speed mixer (T50 UltraTurrax-IKA) equipped with high shear impeller. The stirring head was inserted in a beaker and stirring was started. The polymer solution with the magnetic nanoparticles (3 ml) were then quickly injected in the gap between the mixer's head and the wall of the beaker by using a 3 mL syringe with a 27G needle, injection speed: 20 mL/min. Stirring was maintained for a certain time then stopped. The resulting fibres were rinsed with precipitating medium (n-butanol).

Figure 6:
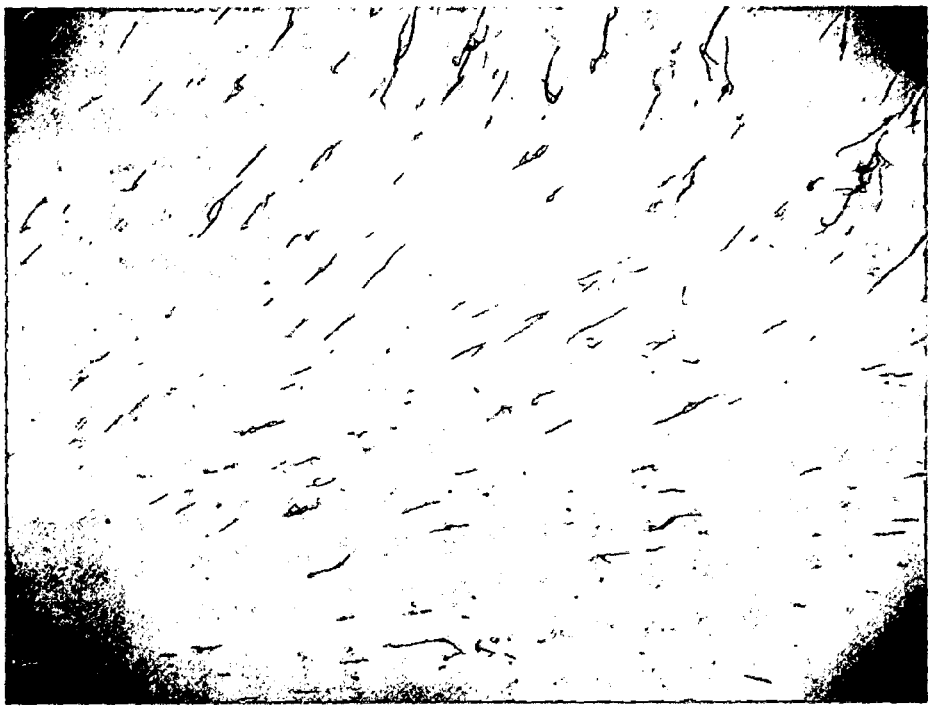
FIG. 6 shows an optical microscopy image of PEAA fibres containing magnetic nanoparticles, aligned with a samarium cobalt-based magnet.

The magnetic nanoparticles were encapsulated by the PEAA fibres and were found to capable of aligning with a magnetic field, as shown in FIG. 6.

It is understood that various other modifications and/or alterations may be made without departing from the spirit of the present invention as outlined herein.

Where the terms "comprise", "comprises", "comprised" or "comprising" are used in this specification (including the claims) they are to be interpreted as specifying the presence of the stated features, integers, steps or components, but not precluding the presence of one or more other feature, integer, step, component or group thereof.

We claim:

1. A process for the preparation of fibres including the steps of:

(a) injecting a stream of fibre-forming liquid into a dispersion medium at a velocity to provide a stream of fibre-forming liquid upon exposure to the dispersion medium and solidifying the stream of fibre-forming liquid to form a filament in the dispersion medium, wherein the fibre-forming liquid has a viscosity higher than the dispersion medium, and the dispersion medium has a viscosity in the range of from about 1 to 100 centiPoise (cP), and wherein the stream of fibre-forming liquid does not emulsify or break up into discrete droplets when injected into the dispersion medium; and (b) applying a shear stress to the dispersion medium to fragment the filament under the shear stress and form the fibres.

2. A process according to claim 1, wherein the dispersion medium has a viscosity in the range of from about 1 to 50 centiPoise (cP).

3. A process according to claim 1, wherein the dispersion medium has a viscosity in the range of from about 1 to 30 centiPoise (cP).

4. A process according to claim 1, wherein the dispersion medium has a viscosity in the range of from about 1 to 15 centiPoise (cP).

5. A process according to claim 1, wherein the ratio of the viscosity of the fibre-forming liquid to the viscosity of the dispersion medium is in the range of from about 2 to 100.

6. A process according to claim 1, wherein the fibre-forming liquid has a viscosity in the range of from about 3 to 100 centiPoise (cP).

7. A process according to claim 1, wherein the fibre-forming liquid has a viscosity in the range of from about 3 to 60 centiPoise (cP).

8. A process according to claim 1, wherein the shear stress has a shear stress rate in the range of from about 100 to about 190,000 cP/sec.

9. A process according to claim 1, wherein steps (a) and (b) are carried out at a temperature not exceeding 50° C.

10. A process according to claim 1, wherein steps (a) and (b) are carried out at a temperature not exceeding 30° C.

11. A process according to claim 1, wherein the fibre-forming liquid is a fibre-forming solution including at least one fibre-forming substance in a solvent.

12. A process according to claim 1, wherein the fibre-forming liquid includes at least one polymer.

13. A process according to claim 1, wherein the dispersion medium includes a solvent selected from the group consisting of an alcohol, an ionic liquid, a ketone solvent, water, a cryogenic liquid and dimethyl sulfoxide.

14. A process according to claim 13, wherein the dispersion medium includes a solvent selected from the group consisting of $C_2$ to $C_4$ alcohols.

15. A process according to claim 1, wherein the fibre-forming liquid contains a polymer in an amount in the range of from about 0.1 to 50% (w/v).

16. A process according to claim 1, wherein the fibres have a diameter in the range of from about 15 nm to about 5 μm.

17. A process according to claim 16, wherein the fibres have a length in the range of from about 1 μm to about 3 mm.

18. A process for the preparation of polymer fibres including the steps of:

(a) injecting a stream of polymer solution into a dispersion medium at a velocity to provide a stream of fibre-forming liquid on exposure to the dispersion medium and solidifying the stream of fibre-forming liquid to form a filament in the dispersion medium, wherein the polymer solution has a viscosity higher than the dispersion medium, and the dispersion medium has a viscosity in the range of from about 1 to 100 centiPoise (cP), and wherein the stream of polymer solution does not emulsify or break up into discrete droplets when injected to the dispersion medium; and (b) applying a shear stress to the dispersion medium to fragment the filament under the shear stress and form the polymer fibres.

19. A process according to claim 18, wherein the dispersion medium has a viscosity in the range of from about 1 to 50 centiPoise (cP).

* * * * *